US010981181B2

(12) United States Patent
Rothman et al.

(10) Patent No.: US 10,981,181 B2
(45) Date of Patent: Apr. 20, 2021

(54) MINERAL BENEFICIATION UTILIZING ENGINEERED MATERIALS FOR MINERAL SEPARATION AND COARSE PARTICLE RECOVERY

(71) Applicant: CiDRA CORPORATE SERVICES LLC, Wallingford, CT (US)

(72) Inventors: Paul J. Rothman, Windsor, CT (US); Mark R. Fernald, Enfield, CT (US); Peter A. Amelunxen, Colebay (SX)

(73) Assignee: CiDRA Corporate Services Inc., Wallingford, CT (US)

( * ) Notice: Subject to any disclaimer, the term of this patent is extended or adjusted under 35 U.S.C. 154(b) by 306 days.

(21) Appl. No.: 15/763,978

(22) PCT Filed: Oct. 17, 2016

(86) PCT No.: PCT/US2016/057322
§ 371 (c)(1),
(2) Date: Mar. 28, 2018

(87) PCT Pub. No.: WO2017/066752
PCT Pub. Date: Apr. 20, 2017

(65) Prior Publication Data

US 2018/0272359 A1 Sep. 27, 2018

Related U.S. Application Data

(60) Provisional application No. 62/242,545, filed on Oct. 16, 2015.

(51) Int. Cl.
*B03D 1/016* (2006.01)
*B03D 1/02* (2006.01)
(Continued)

(52) U.S. Cl.
CPC ..... *B03D 1/016* (2013.01); *B03D 1/023* (2013.01); *B03C 1/01* (2013.01); *B03D 1/0046* (2013.01)

(58) Field of Classification Search
CPC ..... B03D 1/016; B03D 1/023; B03D 1/0046; B03D 1/01; B03C 1/015; B01D 21/0009
See application file for complete search history.

(56) References Cited

U.S. PATENT DOCUMENTS

2011/0114566 A1 5/2011 McCaw et al.
2014/0124414 A1 5/2014 Diez et al.
(Continued)

FOREIGN PATENT DOCUMENTS

WO 2012162614 A1 11/2012
WO 2013074151 A2 5/2013
(Continued)

*Primary Examiner* — Charles A Fox
*Assistant Examiner* — Kalyanavenkateshware Kumar
(74) *Attorney, Agent, or Firm* — Ware, Fressola, Maguire & Barber LLP

(57) ABSTRACT

A selective recirculation circuit has a loading stage, a stripping stage and a filtering stage for use in processing a feed stream or slurry containing mineral particles. The stripping stage forms a first loop with the loading stage, and a second loop with the filtering stage. The loading stage has a loading mixer and a loading washing screen. The stripping stage has a stripping mixer and a stripping washing screen. The loading mixer receives the slurry and causes barren media in the circuit to contact with the slurry so that the mineral particles in the slurry are loaded onto the barren media. The media is directed to the stripping stage where the mineral particles are removed from the media. The barren media is recycled to the loading stage. The stripping solution recovered from the filtering stage is returned to the stripping stage and the mineral particles are discharged as concentrate.

27 Claims, 15 Drawing Sheets

(51) Int. Cl.

| | |
|---|---|
| *B03D 1/004* | (2006.01) |
| *B03C 1/01* | (2006.01) |

(56) References Cited

U.S. PATENT DOCUMENTS

| | | | |
|---|---|---|---|
| 2015/0041368 | A1 | 2/2015 | Kersey |
| 2015/0151308 | A1 | 6/2015 | Davis |

FOREIGN PATENT DOCUMENTS

| | | | |
|---|---|---|---|
| WO | 2013177267 | A1 | 11/2013 |
| WO | 2015095054 | A2 | 6/2015 |

Approx. area 10m x 15m

MINERAL BENEFICIATION UTILIZING ENGINEERED MATERIALS FOR MINERAL SEPARATION AND COARSE PARTICLE RECOVERY

CROSS-REFERENCE TO RELATED APPLICATION

This application claims benefit to provisional patent application Ser. No. 62/242,545, filed 16 Oct. 2015, which is hereby incorporated by reference in its entirety.

BACKGROUND OF THE INVENTION

1. Technical Field

This invention relates generally to a method and apparatus for processing comminution product into concentrate.

2. Description of Related Art

A conventional mineral process plant for base metals porphyry type deposits (i.e. copper sulfide beneficiation) consists of multiple stages of comminution and froth flotation. The comminution stages are required to break the host or matrix rock to expose the crystals or grains of sulfide minerals. This process requires very large amounts of energy—typically 50% or more of the total energy required to produce base metals from their ores. The finer the mineralization of the minerals, the finer the required grind size and therefore the higher the energy requirements. It is recognized that the incremental energy required for given size reduction increases exponentially with size of the particle.

It is also recognized that different kinds of comminution equipment are more efficient than others, depending on the hardness of the ore and range of particle size reduction. For very large particles, such as run-of-mine ore, gyratory crushers are the most efficient. For hard or dry intermediate particles, such as gravels and aggregates, cone crushers and high pressure grinding rolls crushers are more efficient. For wet or soft intermediate particles, semi-autogenous grinding (SAG) or fully-autogenous grinding (AG) mills are more efficient. For finer grinding applications, horizontal ball mills are the equipment of choice. For very fine or ultra-fine grinding, vertical mills, media detritors, Isamills®, and other specially design equipment are the most energy-efficient. All of the above comminution innovations were developed to minimize the power required to achieve a given product particle size assuming some fixed feed particle size.

An alternative method of reducing the power requirement is to increase the product particle size and therefore reduce the amount of comminution work that must be performed. This approach is problematic because it often compromises the recovery in the downstream froth flotation process due to the reduction in liberated surfaces of hydrophobic minerals. For this reason, mineral processing plants try to operate at an economic optimum grind size (particle size), defined as that point at which any incremental recovery benefit for grinding finer is equal to the incremental cost of energy and grinding media required to achieve that grind.

There are many alternative configurations of comminution and flotation circuits. FIG. 1 shows one such configuration, comprised of the following process equipment:

1. A primary crusher, usually a gyratory crusher or a jaw crusher.

2. A screen to remove the coarse particles from the primary crusher product and send them to the secondary crushers.
3. Secondary crushers, often shorthead or cone crushers (a kind of gyratory crusher specially designed for intermediate sized particles).
4. Tertiary crushers, which can be either gyratory or high pressure grinding rolls crushers.
5. Another screen, to treat the tertiary crusher product and to return any oversized or uncrushed particles to the tertiary crusher. The average screen opening can be between 4 mm and 12 mm, but is usually around 5 mm.
6. One or more ball mills that are in closed circuit with a classifier. The classifier—most often a cyclone—removes the coarse, unfinished product and returns it to the ball mill while permitting the finished, fine particles to advance to the flotation stage.
7. A rougher or rougher-scavenger flotation stage, in which the ground ore is upgraded via one or more froth flotation units.
8. A regrinding stage, to further grind the concentrates of the rougher flotation step.
9. A series of cleaning stages, which can be anywhere from one to ten individual stages depending on the equipment size, configuration and ore properties.
10. Thickeners, to remove excess water from various process streams. The most important stream for the purpose of water recovery is the plant tails, as this contains the bulk of the water that was input to the process. The tailings thickeners can be very large depending on the grind size, ore properties, and desired water recovery.
11. A filtration stage, to remove excess water from the thickened concentrate (so that the concentrate can be safely shipped).

The above flowsheet, and all current state-of-the-art sulfide beneficiation flowsheets, suffer from several drawbacks, namely:

1. The grinding process is extremely energy intensive and is responsible for a large percentage of the total cost of production.
2. Because flotation occurs most efficiently at lower percent solids than that of grinding, water is required to enable the flotation. This water must then be removed via the thickeners. A more efficient separation process would be one that could occur at the higher % solids that are optimum for grinding mills.

There is a need in the mining industry to provide a better way to process the comminution product.

SUMMARY OF THE INVENTION

The present invention offers a solution to the above limitations of traditional sulfide mineral beneficiation. The nature of the solution stems from the unique ability of the invented process to:

1. Offer a higher sulfide mineral recovery rate for a given liberation percentage, because, unlike froth flotation, it does not allow particle detachment after capture
2. Operate without the need for air, and hence without the need to achieve an air-water separation.
3. Operate at higher pulp percent solids, which allow for reduced water requirements than traditional froth flotation methods.

The above qualities allow for a significant reduction in capital cost, operating cost, water requirements, and energy requirements when the invented process is used for sulfide mineral beneficiation. FIG. 2 shows a possible configuration of the invented circuit herein referred to as a selective recirculation circuit. It consists of two co-current circulating loops of media and stripping solution. The barren media is contacted with the feed stream (slurry and unrecovered sulfide mineral particles), where the sulfide minerals are loaded on the media. The media is separated from the slurry on a vibrating screen equipped with wash water sprays ("washing screen"). The loaded media is then contacted with a stripping stage, which removes the sulfide particles from the media. The barren media is then recovered and returned to the loading stage. The strip solution is recovered in a filter and returned to the stripping stage. The mineral particles are recovered in a concentrate stream.

The selective recirculation circuit can be used in a sulfide beneficiation process as shown in FIGS. 4, 5 and 6. This process has the same primary, secondary and tertiary crushing configuration as the traditional beneficiation flowsheet shown in FIG. 1 but there are numerous unique features about the grinding and flotation steps. They are:

1. There is a classification step before the ball mills, consisting of a desliming classifier, most likely a hydrocyclone operating at a d50 cut size of around 300 to 500 microns, in order to remove most of the fine particles from the ball mill feed. This material—perhaps around 20% to 30% of the total mass flow through the process, is optionally directed to a flash flotation device (i.e. a Contact Cell or similar pneumatic flotation device) to recover hydrophobic sulfide particles. The flotation tails are then thickened to recover process water and return it to screen. The concentrates are direct, optionally, to one of the downstream regrinding steps (depending on the particle size of that stream).
2. The ball mills are no longer operated in closed circuit with hydrocyclones; they are now operated in open circuit. This eliminates the high circulating loads (100% to 500% of the fresh feed is recirculated to the mill) that characterize normal ball mill operations, and allows for a reduction of between 65% and 80% of size of the ball milling circuit depending on the cut size selected for the pre-classification step.
3. The ball mill product is classified with either a screen or a hydrocyclone operating at a D50 cut size of around 1 mm. The coarse particles are then directed to a selective recirculation circuit. Any recovered coarse particles are returned to the grinding mills, while the unrecovered particles are directed to tails. This is significantly different from the traditional configuration, in which all of the coarse material is returned to the ball mill. Because the selective recirculation circuit is optimized for coarse particle recovery (because there is very little detachment), only those particles with some exposed hydrophobic faces are recycled to the ball mill, greatly reducing the amount of work that must be done in that comminution step. For the remainder of this document, this concept has been termed "selective recirculation".
4. The classifier fines—now only 15% to 50% of the original feed but containing perhaps 80% to 95% of the sulfide minerals in the original feed—are then directed to a secondary grinding step, consisting of vertical mills. Vertical mills are up to 35% more efficient than ball mills for processing fine particles (less than 1 mm); hence, they are a better choice for this fine grinding application. Like the previous grinding step, the vertical mills are configured with a product classifier and selective recirculation circuit operating in selective recirculation configuration. This allows for the rejection of between 70% and 99% of the remaining material while recovering almost all of the reground sulfide minerals.
5. Optionally, the vertical mill circuit product is again treated in a flash flotation device—a contact cell or other pneumatic flotation cell—to remove the fastest, highest-grade particles. The tails are then combined with the tails of the first contact cell and directed to a third selective recirculation circuit scavenging any remaining sulfide particles.
6. The recovered sulfide particles from the "Scavenger" selective recirculation circuit are combined with the concentrates of the Contact Cells and directed to a third and final grinding step, termed the "Polishing Mills". These mills are operating at very fine grinds—typically 30 to 75 microns—and therefore IsaMills or Stirred Media Detritors (SMD) would be more appropriate for this size range. The final product—containing between 1% and 5% of the original plant feed but perhaps 80% to 95% of the desirable sulfide minerals—is then floated a third and final time, then directed to a "Cleaner" selective recirculation circuit. The tails of this selective recirculation circuit is recycled to a prior step (Intermediate flotation in the diagram shown).

In an embodiment, the present invention provides a method and apparatus for collecting mineral particles in a feed stream containing slurry and mineral particles, the method and apparatus comprising three stages: a loading stage, a stripping stage and a filtering stage. In the loading stage, the mineral particles in the received feed stream are loaded on barren media to provide loaded media. In the stripping stage, the loaded media is stripped with a stripping solution for separating the mineral particles from the barren media, wherein the barren media is returned to the loading stage for further use and the mineral particles along with the stripping solution are directed to the filtering stage where the stripping solution is recycled back the stripping stage and the mineral particles are directed to concentrates. In the feed stream where the mineral particles comprise recovered particles having exposed hydrophobic faces and unrecovered particles, the loaded media comprises the recovered particles and the unrecovered particles may be discharged along the slurry from the loading stage.

In an embodiment of the present invention, the stripping stage forms a first loop with the loading stage and forms a second loop with the filtering stage. As such, the stripping stage is configured to provide barren media to the loading stage and to receive loaded media from the loading stage via the first loop, while the stripping stage is configured to receive the stripping solution from the filtering stage and to provide the recovered particles to the filtering stage via the second loop.

Thus, the first aspect of the present invention is an apparatus, comprising:

a loading stage configured to receive barren media and a slurry containing mineral particles and to load the barren media with the mineral particles for providing loaded media;

a stripping stage configured to strip the loaded media with a stripping solution into a first portion comprising the barren media and a second portion containing the mineral particles and the stripping solution; and a filtering stage configured to separate the mineral particles from the stripping solution in the second portion.

According to some embodiments of the present invention, the barren media comprises engineered material having molecules with a functional group configured to attract the mineral particles to the engineered material.

According to some embodiments of the present invention, the engineered material comprises synthetic bubbles and beads having a surface to provide the molecules.

According to some embodiments of the present invention, the synthetic bubbles and beads are made of a hydrophobic material having the molecules.

According to some embodiments of the present invention, the surface of the synthetic bubbles and beads comprises a coating having a hydrophobic chemical selected from the group consisting of poly(dimethysiloxane), hydrophobically-modified ethyl hydroxyethyl cellulose polysiloxanes, alkylsilane and fluoroalkylsilane.

According to some embodiments of the present invention, the surface of the synthetic bubbles and beads comprises a coating made of one or more dimethyl siloxane, dimethyl-terminated polydimethylsiloxane and dimethyl methylhydrogen siloxane.

According to some embodiments of the present invention, the surface of the synthetic bubbles and beads comprises a coating made of a siloxane derivative.

According to some embodiments of the present invention, the stripping stage is arranged to form a first loop with the loading stage, and to form a second loop with the filtering stage.

According to some embodiments of the present invention, the stripping stage configured to provide the first portion containing the barren media to the loading stage and to receive the loaded media via the first loop; and to provide the second portion to the filtering stage and to receive the stripping solution from the filtering stage via the second loop.

According to some embodiments of the present invention, the filtering stage is configured to output concentrates containing the mineral particles.

According to some embodiments of the present invention, the mineral particles comprise recovered particles having exposed hydrophobic surfaces and unrecovered particles, and wherein the loading stage comprises a mixing stage and a screening stage, the mixing stage configured to load the barren media with the recovered particles and the screening stage configured to discharge the unrecovered particles from the loading stage.

According to some embodiments of the present invention, the loading stage comprises a media loading stage and a loaded media recovery stage, the media loading stage configured to load the barren media with mineral particles, the loaded media recovery stage configured to separate the loaded media from the slurry.

According to some embodiments of the present invention, the stripping stage comprises a media stripping stage and a barren media recovery stage, the media stripping stage configured to strip the mineral particles from the loaded media, the barren media recovery stage configured to return the barren particles in the stripping stage to the media loading stage.

According to some embodiments of the present invention, the mineral particles comprise recovered particles and unrecovered particles, the loaded media containing the recovered particles, and wherein the media loading stage comprises an input arranged to receive the slurry and the loaded media recovery stage comprises a first output arranged to discharge the unrecovered particles, and wherein the filtering stage comprises a second output arranged to output the recovered particles.

According to some embodiments of the present invention, the method further comprises a milling stage and a classifying stage, the milling stage configured to mill a first comminution product into a second comminution product, the classifying stage configured to separate coarser particles from finer particles in the second comminution product, and wherein the slurry comprises process water and the coarser particles containing the mineral particles, and wherein the input is arranged to receive the slurry from the classifying stage, and the second output is arranged to return the recovered particles to the milling stage.

According to some embodiments of the present invention, the finer particles in the second comminution product are directed to a further milling stage.

According to some embodiments of the present invention, the finer particles in the second comminution product are further regrinding in the further milling stage into a first reground product and a second reground product having coarse particles than the first reground product, wherein the first reground product is directed to flotation.

According to some embodiments of the present invention, the second reground product also comprises unrecovered particles to be discharged as tails.

According to some embodiments of the present invention, the input is arranged to receive the slurring from a flotation cell.

The second aspect of the present invention is a method for processing a slurry having mineral particles, comprising:

causing barren media to contact with the slurry;

loading the mineral particles on the barren media for providing loaded media in the slurry;

separating the loaded media from the slurry;

stripping the loaded media to obtain mineral particles and barren media; and discharging the mineral particles in a concentrate stream.

According to some embodiments of the present invention, the causing and loading are carried out in a loading stage and said separating and stripping are carried out in a stripping stage, the method further comprising:

returning the barren media obtaining from said stripping to the loading stage.

According to some embodiments of the present invention, a stripping solution is used in the stripping stage in said stripping, the method further comprising:

receiving mixture of the mineral particles and the stripping solution from the stripping stage;

separating the mineral particles and the stripping solution from the mixture; and providing the stripping solution to the stripping stage.

According to some embodiments of the present invention, the barren media comprises engineered material having molecules with a functional group configured to attract the mineral particles to the engineered material.

According to some embodiments of the present invention, the engineered material comprises synthetic bubbles and beads having a surface to provide the molecules.

According to some embodiments of the present invention, the synthetic bubbles and beads are made of a hydrophobic material having the molecules.

According to some embodiments of the present invention, the surface of the synthetic bubbles and beads comprises a coating having a hydrophobic chemical selected from the group consisting of poly(dimethysiloxane), hydrophobically-modified ethyl hydroxyethyl cellulose polysiloxanes, alkylsilane and fluoroalkylsilane.

According to some embodiments of the present invention, the surface of the synthetic bubbles and beads comprises a coating made of one or more dimethyl siloxane, dimethyl-terminated polydimethylsiloxane and dimethyl methylhydrogen siloxane.

According to some embodiments of the present invention, the surface of the synthetic bubbles and beads comprises a coating made of a siloxane derivative.

DETAILED DESCRIPTION OF THE INVENTION

Figure 1:
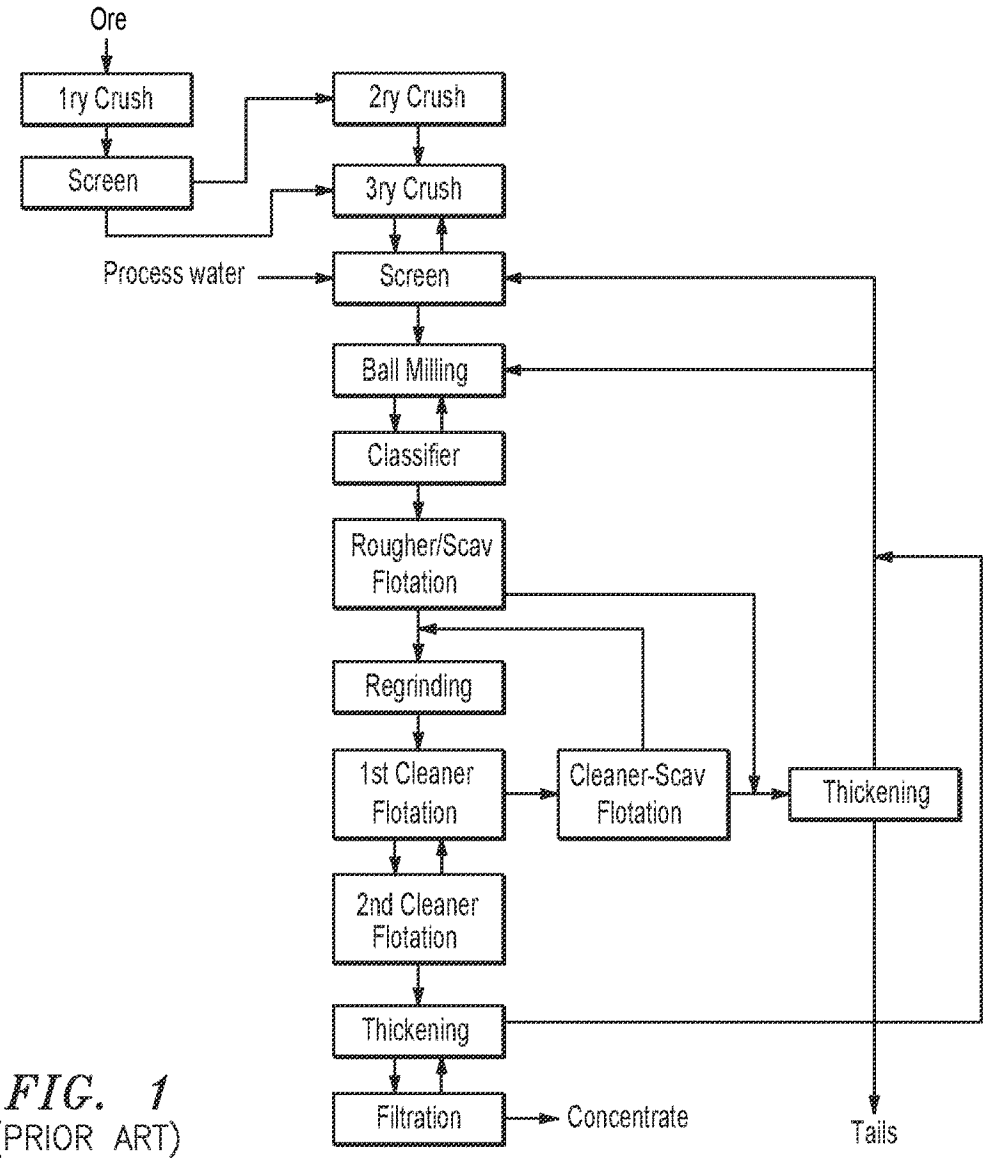
FIG. 1 (PRIOR ART)
FIG. 1 is a flowsheet depicting a prior art process for sulfide beneficiation.
Figure 2:
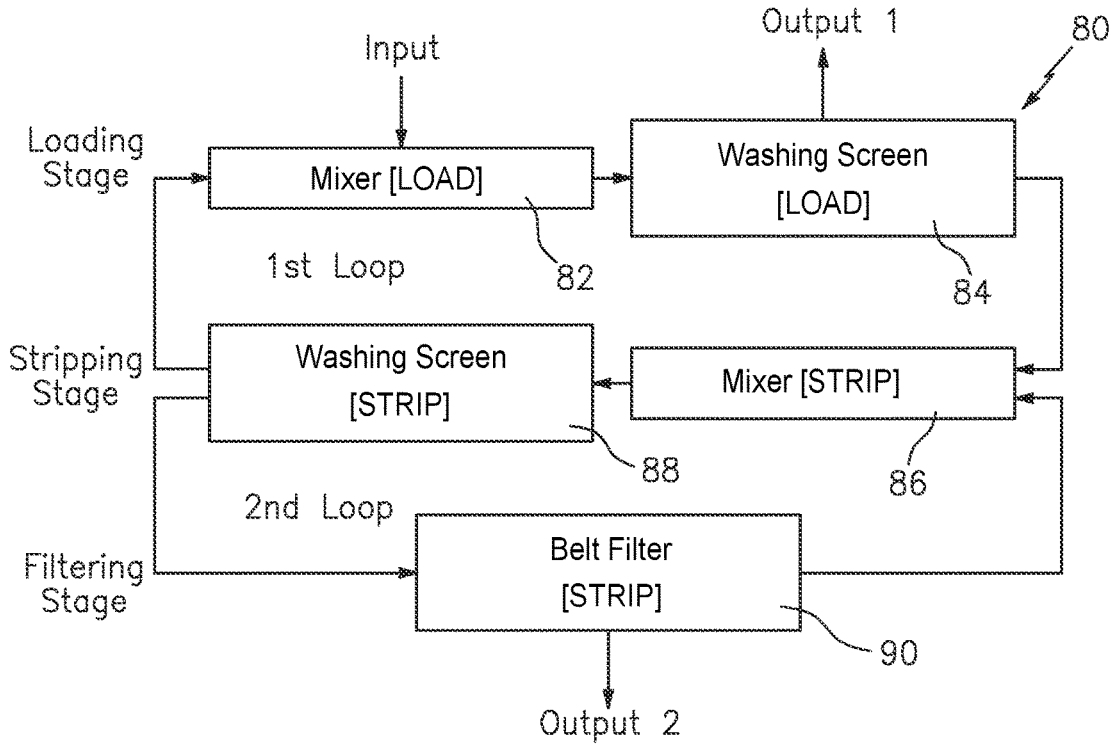
FIG. 2 illustrates a selective recirculation circuit, according to an embodiment of the present invention.
Figure 2A:
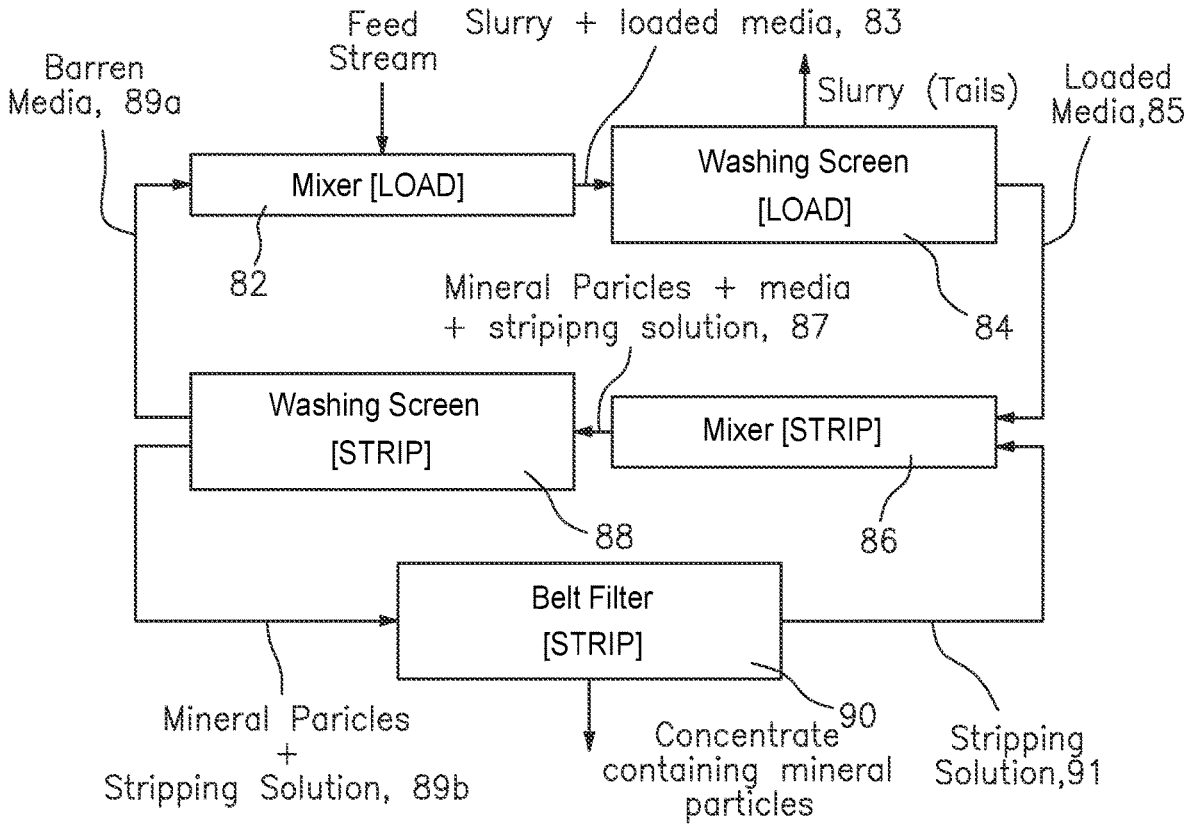
FIG. 2*a* illustrates an application of the selective recirculation circuit, according to an embodiment of the present invention.
Figure 3:
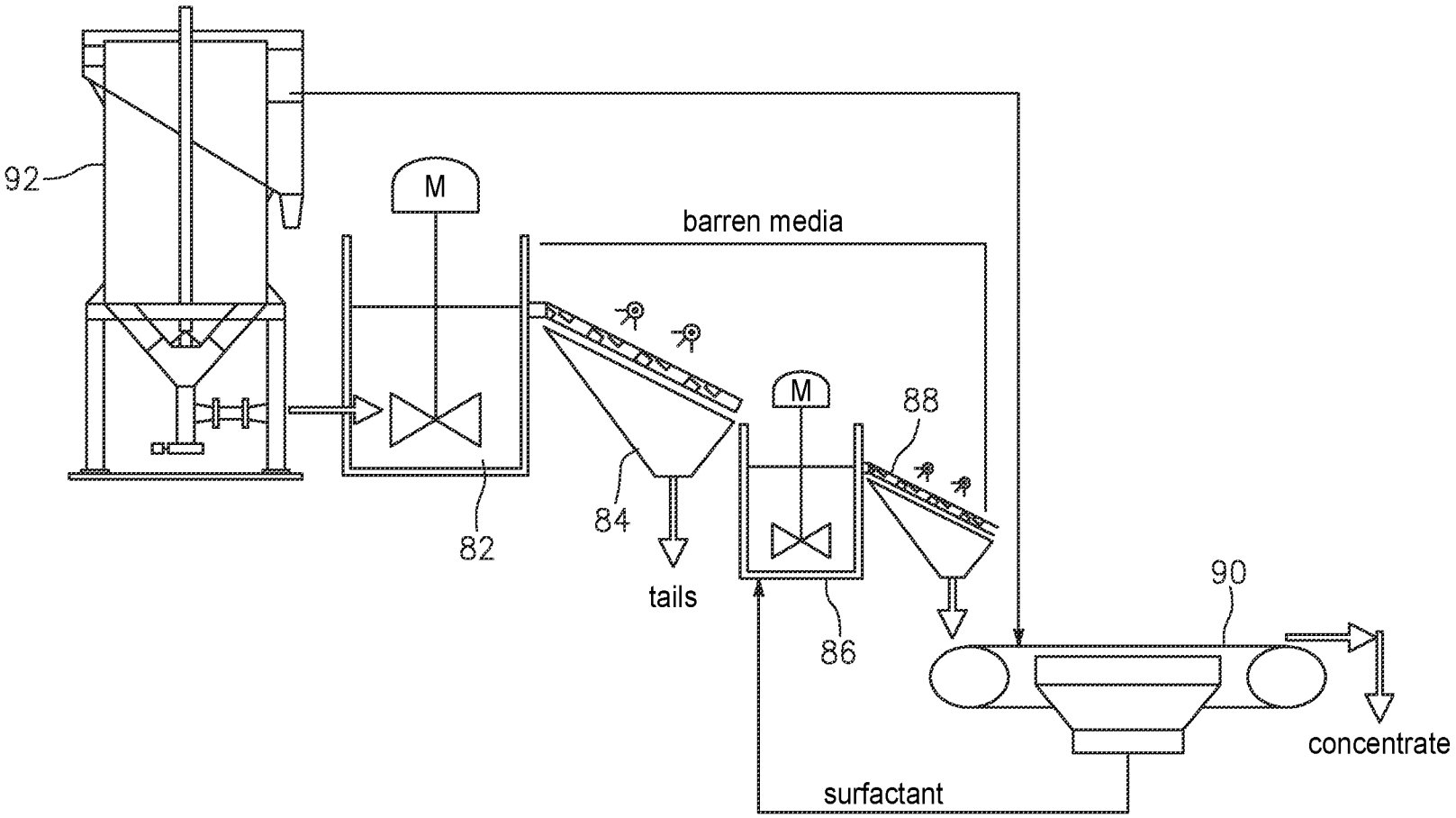
FIG. 3 illustrates an application of the selective recirculation circuit, according to an embodiment of the present invention.

FIGS. 2, 2*a* and 3

By way of example, FIG. 2 shows the present invention in the form of block diagrams presenting various stages in a selective recirculation circuit 80, according to an embodiment of the present invention. The selective recirculation circuit 80 consists of two co-current circulating loops of media and stripping solution. The circuit 80 comprises a loading stage, a stripping stage and a filtering stage. The stripping stage is configured to form a first loop with the loading stage and a second loop with the filtering stage. The loading stage comprises a mixer 82 and a washing screen 84, and the stripping stage comprises a mixer 86 and a washing screen 88. The stripping stage is linked a filter 90 of the filtering stage. The selective recirculation 80 has an input provided to the mixer 82, an output 1 provided on the washing screen 84 and an output 2 provided on the filter 90.

The selective recirculation circuit 80 has many different uses. One of those uses is depicted in FIG. 3.

FIG. 3 shows the present invention in the form of apparatus comprising of two sets of mixer-separators, each of which is used as an agitation tank to a screen. As shown in FIG. 3, barren media is contacted with the feed stream (slurry and unrecovered sulfide mineral particles) from input 1, where the sulfide minerals are loaded on the media in the mixer 82, and the media is directed to the washing screen 44, where the media is separated from the slurry on a vibrating screen equipped with wash water sprays ("washing screen"). The loaded media is then contacted with the stripping stage, which removes the sulfide particles from the media. In the stripping stage, after the loaded media in the mixer 86 is stirred, it is directed to the washing screen 88, where the barren media is recovered and returned to the loading stage. The strip solution is recovered in the filter 90 and returned to the stripping stage. The mineral particles are recovered in a concentrate stream. In FIG. 3, the mixer 82 receives the feed form a flotation stage (contact cell) 92.

In the above disclosed application, the selective recirculation circuit 80 can be depicted in FIG. 2*a*, the input of the selective recirculation circuit 80 is arranged to receive the tails from a flotation stage 82 as feed of slurry and mineral particles. Output 1 is used to discharge the slurry as tails and the output 2 is used to output concentrates. As shown in FIG.

2*a*, the loading mixer 82 also receives barren media 89*a* from the stripping stage and causes the barren media to contact with slurry so that the mineral particles in the slurry are loaded on the barren media. The mixture 83 of slurry and loaded media are directed to the loading washing screen 84 where loaded media are separated from the slurry which is discharge as tails. The loaded media 85 is directed to stripping mixer 86 where mineral particles are stripped from the loaded media. The mixture 7 of mineral particles, the media and the stripping solution is directed to the stripping washing screen 88 where barren media 89*a* is returned to the loading stage, whereas the mineral particles and stripping solution in mixture 89*b* are separated by the filter 90. The stripping solution 91 is recycled to the stripping stage, while the mineral particles are discharged as concentrates.

Figure 2B:
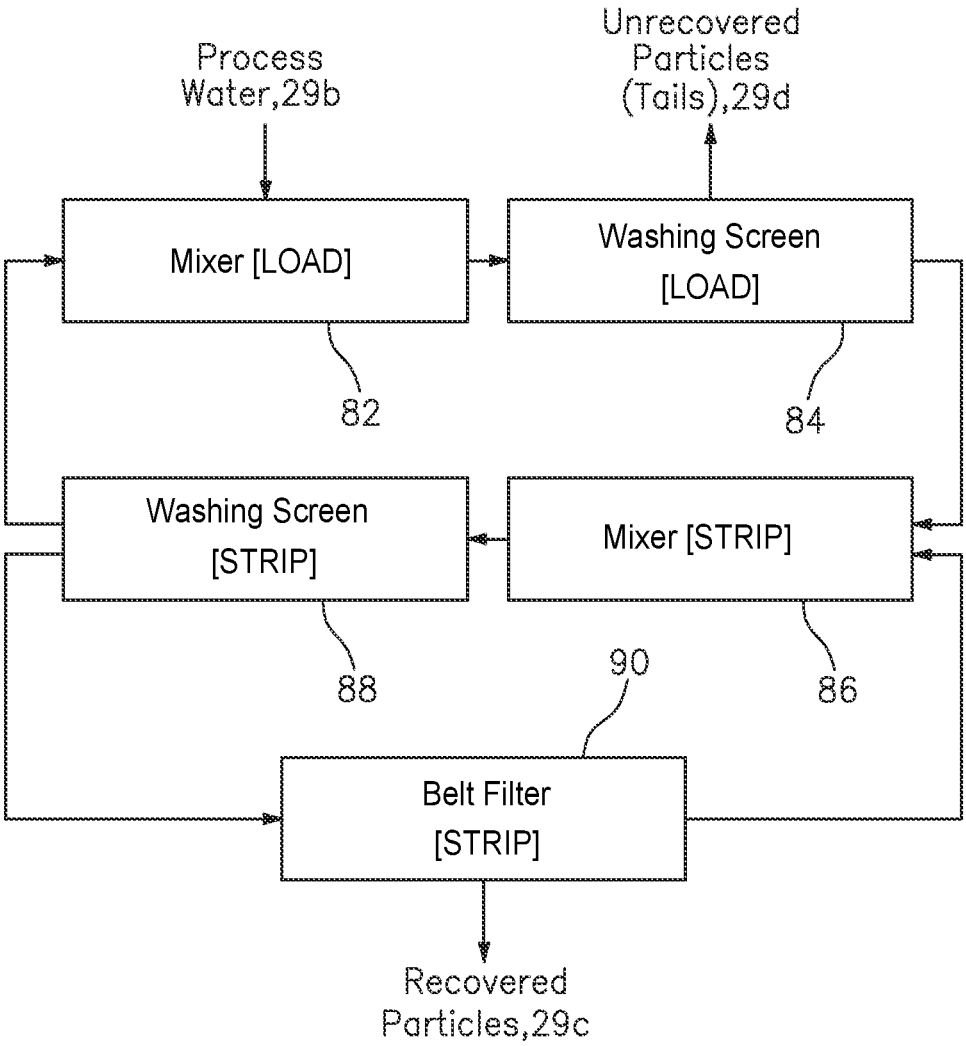
FIG. 2*b* illustrates a different application of the selective recirculation circuit, according to an embodiment of the present invention.
Figure 4:
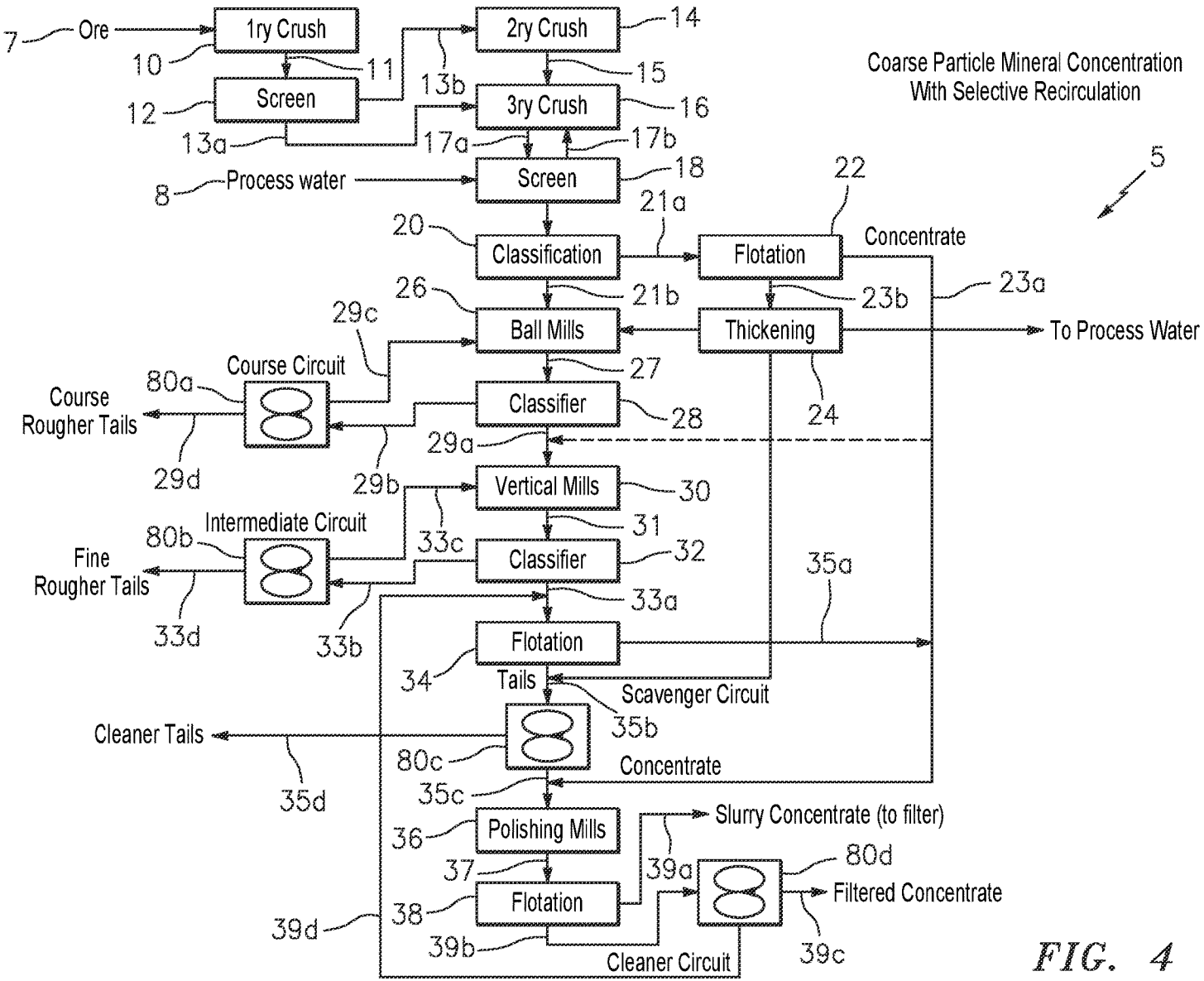
FIG. 4 is a flowsheet depicting a process of sulfide beneficiation that uses the selective recirculation, according to an embodiment of the present invention.
Figure 5:
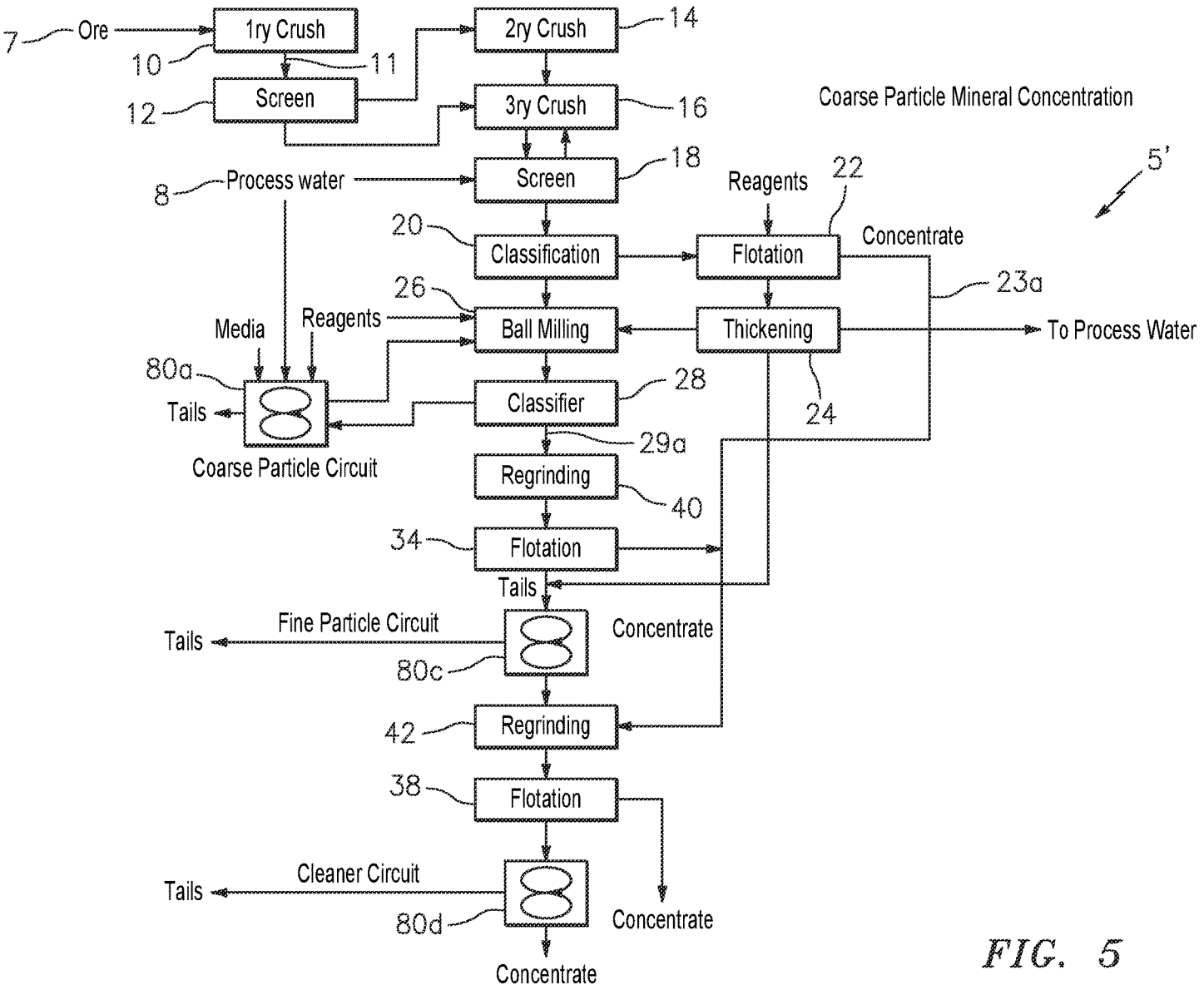
FIG. 5 is a flowsheet depicting a process of sulfide beneficiation that uses the selective recirculation, according to another embodiment of the present invention.

FIGS. 2*b*, 4 and 5

The selective recirculation circuit 80 can be used in a coarse particle mineral concentration process as shown in FIGS. 4 and 5. The use of the selective recirculation circuit 80 in sulfide beneficiation is presented in the form of a flowsheet of processing stages.

As seen in FIG. 4, the sulfide beneficiation process shown in flowsheet 5 comprises a first crushing stage 10 which receives ore 7 and crushes the received ore into a first comminution product 11. The first crushing stage 10 may use a gyratory crusher or a jaw crusher. The first comminution product 11 is directed to a first screening stage 12 where a screen is used to separate the coarser particles and the finer particles. The coarser particles 13*b* are sent to a second crushing stage 14 for further crushing. The second crushing stage 14 may use a shorthead or cone crusher designed for intermediate sizes particles. The finer particles 13*a* in the first comminution product 11 as well as the second comminution product 15 from the second crushing stage 14 are directed to a third crushing stage 16 for further crushing. The third crushing stage 16 may use a gyratory or high pressure grinding rolls to crush the received product into a third comminution product 17*a*. A second screening stage 18 is used to remove and return oversized or uncrushed particles 17*b* to the third crushing stage 16. The second screening stage 18 may use a screen having an average screen opening between 4 mm and 12 mm, but is usually around 5 mm. The second screening stage 18 is configured to receive process water 8 while screening the third comminution product 17*a*. The screened particles 19 are directed to a first classifying stage 20. The first classifying stage 20 may use a cyclone to separate the coarse, unfinished product from the fine, finished product. The first classifying stage 20 may consist of a de-sliming classifier, such as a hydrocyclone operating at a D50 cut size of around 300 to 500 microns, in order to remove most of the fine particles from the ball-mill feed 21*b*. The fine, finished product 21*a* which is probably around 20% to 30% of the total mass flow through the process, is directed to an optional first flotation stage 22. The first flotation stage 22 may use a flash flotation device (i.e. a contact cell or similar pneumatic flotation device) to recover hydrophobic sulfide particles as concentrates 23*a*. The flotation tails 23*b* are directed to a thickening stage 24 where the tails are thickened in order to recover process water 8 and return it to the second screening stage 18. The concentrates 23*a* are directed, optionally, to one of the downstream regrinding steps (depending on the particle size of that stream).

The ball-mill feed 21*b* is directed to a first milling stage 26. The first milling stage 26 may use one or more ball mills for milling. It should be noted that the ball mills in the first milling stage 26 are no longer operated in closed circuit with hydrocyclones in the second classifying stage 28. The ball mills in the first milling stage 26 are operated in open circuit. This eliminates the high circulating loads (200% to 500% of the fresh feed is recirculated to the mill) that characterize normal ball mill operations, and allows for a reduction of between 65% and 80% of size of the ball milling circuit depending on the cut size selected for the pre-classification step.

The ball mill product 27 is classified in a second classifying stage 28, which uses either a screen or a hydrocyclone operating at a D50 cut size of around 1 mm. The coarse particles 29*b* from the second classifying stage 28 are directed to a first selective recirculation circuit 80*a*, wherein recovered coarse particles 29*c* are returned to the first milling stage 26, while unrecovered particles 29*d* are directed to tails. This is significantly different from the traditional configuration, in which all of the coarse material is returned to the ball mills. The selective recirculation circuit 80*a* is optimized for coarse particle recovery (because there is very little detachment). As such only those particles with some exposed hydrophobic faces are contained in the recovered particles 29*c* to be recycled to the ball mills in the first milling stage 26. The use of the selective recirculation circuit 80*a* greatly reduces the amount of work that must be done in this comminution step.

The classifier fines 29*a*—now only 15% to 50% of the original feed but containing perhaps 80% to 95% of the sulfide minerals in the original feed—are then directed to a second milling stage 30 for a secondary grinding step. The second milling stage 30 may consist of vertical mills. Vertical mills are up to 35% more efficient than ball mills for processing fine particles (less than 1 mm); hence, they are a better choice for this fine grinding application. Like the previous grinding step carried out in the first milling stage 26, the vertical mills in the second milling stage 30 are configured with a product classifier in a third classifying stage 32 and another selective recirculation circuit 80*b* operating in selective recirculation configuration. This allows for the rejection of between 70% and 99% of the remaining material while recovering almost all of the reground sulfide minerals.

The vertical mill product 31 is again treated in a third classifying stage 32. As with the second classifying stage 28, the coarser particles 33*b* from the third classifying stage 32 are directed to a second selective recirculation circuit 80*b*, wherein recovered coarse particles 33*c* are returned to the second milling stage 30, while unrecovered particles 33*d* are directed to tails. The classifier fines 33*a* are directed to an optional second flotation stage 34 which may use a flash flotation device—a contact cell or other pneumatic flotation cell—to remove the finest, highest-grade particles 35*a* from the vertical mill product 31, to be directed to a third milling stage 36. The tails 35*b* from the second flotation stage 34 are then combined with the tails from the thickening stage 24 and directed to a third selective recirculation circuit 80*c* for scavenging any remaining sulfide particles. The unrecovered particles 35*d* from the third selective recirculation circuit 80*s* are directed to tails, while recovered sulfide particles 35*c* from the third selective recirculation circuit 80*a* are combined with the concentrates 23*a* from the contact cells in the first flotation stage 22 and the finest particles 35*a* from the second flotation stage 34 and directed to the third milling stage 36, where "polishing mills" are used for the final grinding step. The term "polishing mills" refers to the mills that are operating at very fine grinds—typically 30 to 75 microns—and therefore IsaMills or Stirred Media Detritors (SMD) would be more appropriate for this size range. The final product 37 from the third milling stage 36—containing between 1% and 5% of the original plant feed but perhaps 80% to 95% of the desirable sulfide minerals—is then directed to a third flotation stage 38 to be floated a third and final time. The high grade particles 39*a* is collected as slurry concentrate, while tails 39*b* are directed to a fourth selective recirculation circuit 80*d*. The tails 39*d* of the fourth selective recirculation circuit 80*d* are recycled to a prior step (the second flotation stage 34). The recovered particles 39*c* becomes part of the filtered concentrate.

The benefits of using the first classifying stage 20 and various selective recirculation stages, when compared to a traditional process, include:

1. The prospect of selective recirculation offers the potential for very significant energy reductions. To wit:
   a. A significant portion of the plant feed—between 50% and 85% depending on the mineralogical characteristics of the sulfides—is rejected to tails before it is ground any finer than around 2 to 3 mm (P80, approximate). This offers very significant energy savings.
   b. A further 10% to 40% are rejected to tails at or around 200 to 400 microns in the Intermediate or second selective recirculation circuit, offering further savings.
2. The higher thickening of only the fines stream rather than the entire plant tails offers the possibility of a very large reduction in the capital cost and floor space requirements of the thickeners and water recovery system.
3. The recovery of sulfide minerals at very high densities in the coarse or first selective recirculation stage and the Intermediate or second selective recirculation stage eliminate the need for copious amounts of dilution water required for the operation of traditional rougher flotation cells. This is a very significant cost savings, particularly in dry climates or at high elevation, where water pumping and perhaps desalination facilities are a large fraction of the total infrastructure costs.
4. The use of selective recirculation circuits, according to the present invention, does not require bubble-particle attachment, allows for a significant reduction in the flotation residence time and therefore floor space and energy requirements when compared to the traditional circuit configuration.

It should be noted that the selective recirculation circuit 80 can be used in two different ways in the coarse particle mineral concentration process as depicted in the flowsheet 5: One way is to provide a selective recirculation link between a milling stage and an associated classifying stage. The link is configured to receive coarse particles from the classifying stage and to discard the unrecovered particles as tails so that only the covered coarse particles are returned to the milling stage (see FIG. 2*b*). The other way is to receive tails from a flotation stage as feed and to obtain concentrates by removing the tails from the feed. (see FIGS. 2*a* and 3).

The incorporation of the selective recirculation circuit 80 in coarse particle mineral concentration can be carried out differently. For example, FIG. 5 illustrates a process where only three selective recirculation circuits are used.

As shown in the flowsheet 5', a first regrinding stage 40 is used to replace the second milling stage 30, the third classifying stage 32 and the intermediate selective recirculation circuit 80*b* in the flowsheet 5 (FIG. 4). Furthermore, the polished milling stage 36 in FIG. 4 is now a second regrinding stage 42.

It should be noted that each of the selective recirculation circuits used in the process flow contains barren media and stripping solution. The barren media comprises engineered material having molecules with a functional group configured to attract the mineral particles in feed received in the selective recirculation circuits. The engineered material may comprise synthetic bubbles and beads having a hydrophobic surface to provide the molecules. In an embodiment of the present invention, the synthetic bubbles and beads are made of a naturally hydrophobic material. In another embodiment of the present invention, the surface of the synthetic bubbles and beads comprises a coating having a hydrophobic chemical selected from the group consisting of poly(dimethysiloxane), hydrophobically-modified ethyl hydroxyethyl cellulose polysiloxanes, alkylsilane and fluoroalkylsilane.

In a different embodiment, the surface of the synthetic bubbles and beads comprises a coating made of one or more dimethyl siloxane, dimethyl-terminated polydimethylsiloxane and dimethyl methylhydrogen siloxane. In yet another embodiment, the surface of the synthetic bubbles and beads comprises a coating made of a siloxane derivative.

In an embodiment of the present invention, where mineral particles in the selective recirculation circuit comprise recovered particles having exposed hydrophobic surfaces and unrecovered particles, the loading stage is configured to discharge the unrecovered particles in the tails.

FIG. 6

As disclosed above, a selective recirculation circuit 80 has a loading stage and a stripping stage. The loading stage comprises a mixer 82 and a washing screen 84, and the stripping stage comprises a mixer 86 and a washing screen 88. The stripping stage is linked a filter 90. In a different configuration, the mixer 82 is equivalent to a media loading stage and the washing screen 84 is equivalent to a loaded media stage. The mixer 86 is equivalent to a media stripping stage and the washing screen 88 is equivalent to a barren media recovery stage. The filter 90 is equivalent to a filtration stage. As such, the processing stages in the flowsheet 5 (FIG. 5) can be carried out with equivalent processing stages in the flowsheet 5" of FIG. 6.

Figure 6:
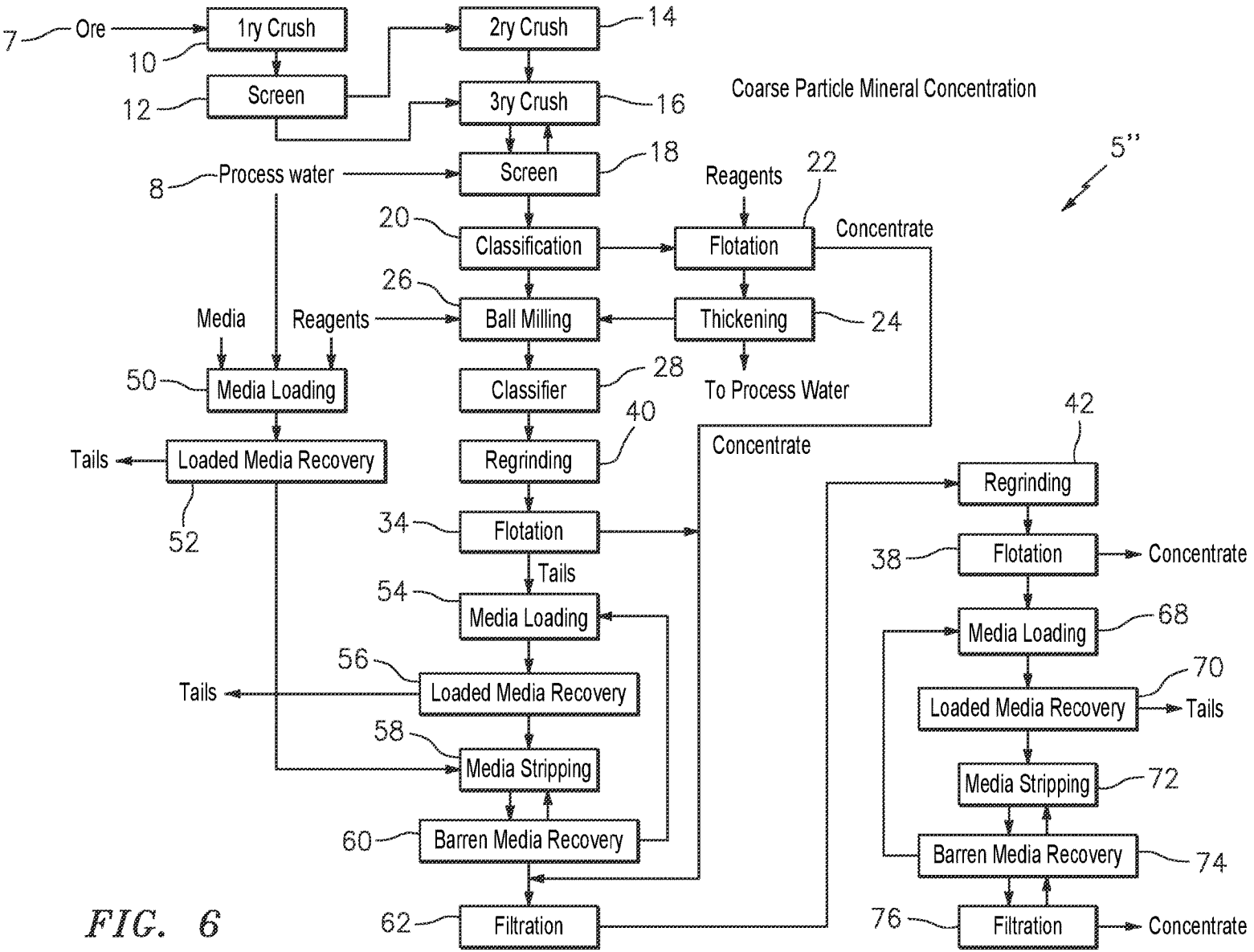
FIG. 6 is a flowsheet depicting a process of sulfide beneficiation, according to a different embodiment of the present invention.

As shown in FIG. 6, the media loading stage 54 and the loaded media recovery stage 56 are equivalent to the mixer 82 and the washing screen 84 in the selective recirculation circuit 80*c* in flowsheet 5'. The media stripping stage 58 and the barren media recovery stage 60 are equivalent to the mixer 86 and the washing screen 88 in the selective recirculation circuit 80*c*. The filtration stage 62 is equivalent to the filter 90 in the selective recirculation circuit 80*c* (see FIGS. 2 and 3). Thus, the media loading stage 54, the loaded media recovery stage 56, the media stripping stage 58, the barren media recovery stage 60 and the filtration stage 62 are together equivalent to the selective recirculation circuit 80*c* in the flowsheet 5' shown in FIG. 5. Likewise, the media loading stage 68, the loaded media recovery stage 70, the media stripping stage 72, the barren media recovery stage 74 and the filtration stage 76 are together equivalent to the selective recirculation circuit 80*d* in the flowsheet 5' shown in FIG. 5. One difference between the processing flowsheet 5' of FIG. 5 and the processing flowsheet 5" of FIG. 6 is that the stripping stage and the filtering stage in after the flotation stage 34 is also used by the loading stage in the selective recirculation circuit 80*a* (see FIG. 5). As such, the media loading stage 50 and the loaded media recovery stage 52 can be linked to the media stripping stage 58. The media loading stage 50 and the loading media recovery stage 52 form a loading stage.

Figure 7:
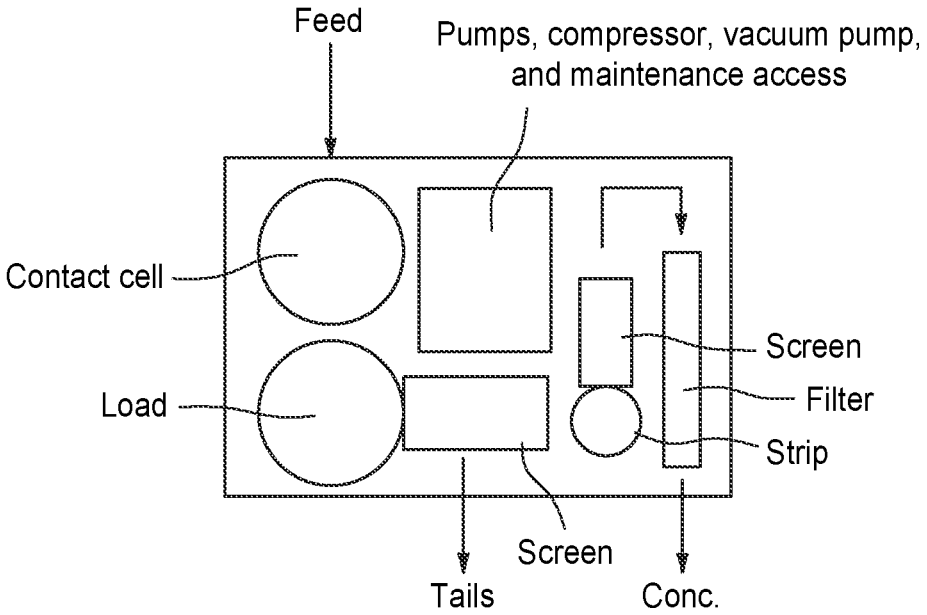
FIG. 7 is a graphical representation depicting the application of the selective recirculation circuit as shown in FIG. 3.
Figure 8:
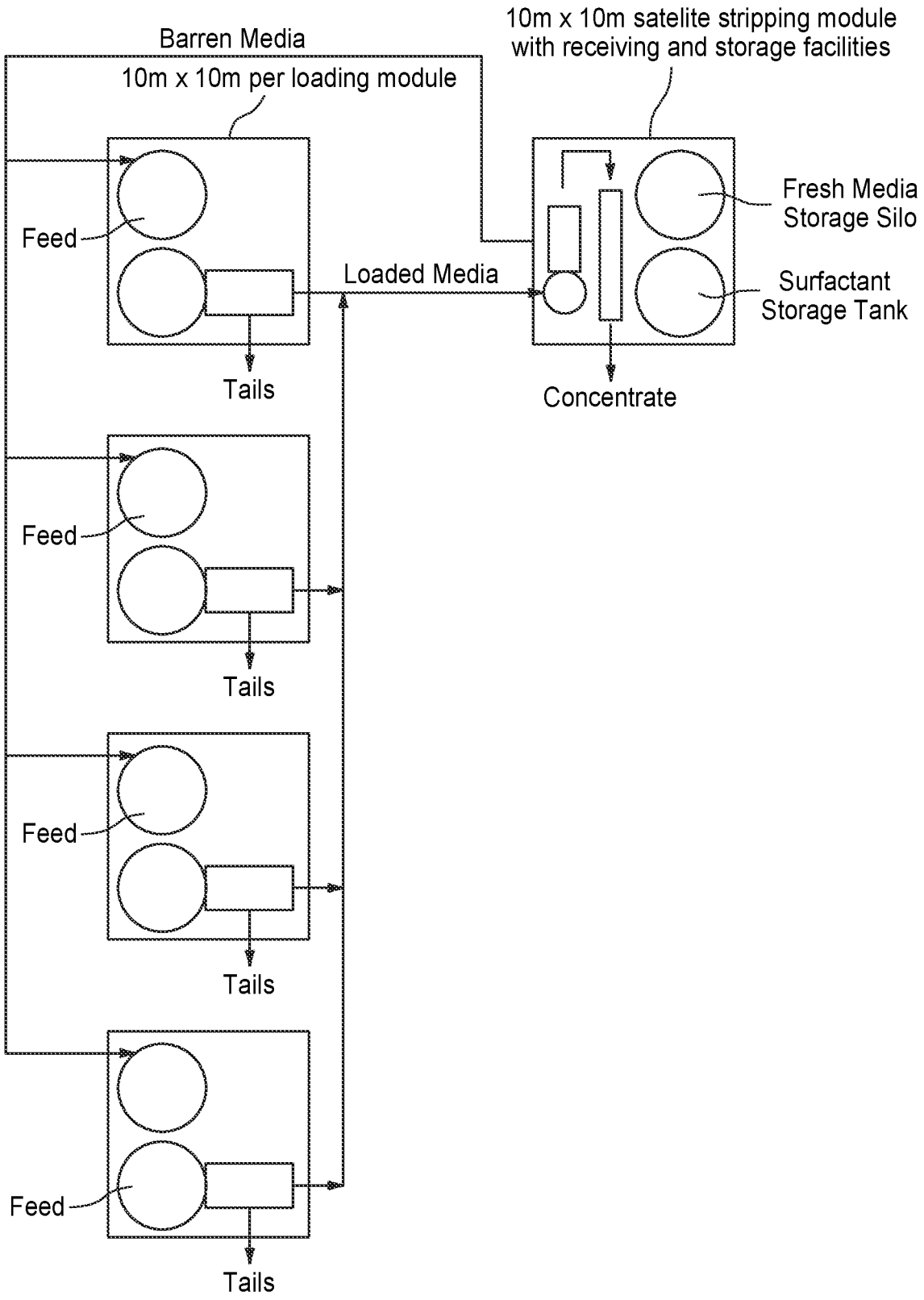
FIG. 8 is a graphical representation showing a number of the loading stages sharing one stripping stage.

FIGS. 7 and 8

The apparatus for extracting concentrates from the tails provided by a flotation stage as shown in FIG. 3 can be linked as a group of separate components as shown in FIG. 7. In FIG. 7, "contact cell" represents the flotation stage 92, "load" represents the mixer 82, "screen" associated with "load" represents the washing screen 84, "strip" represents the mixer 86, "screen" associated with "strip" represents the washing screen 88, "filter" represents the filter 90. "Pumps, compressor, vacuum pump and maintenance access" represents electrical and mechanical equipment used to operate the flotation cell, the mixers, washing screens and the filter. The entire group of components can be arranged in an area about 10 m×15 m. As demonstrated in the flowsheet 5" (FIG. 6), a stripping stage can be shared by two more loading stages as shown in FIG. 7.

As shown in FIG. 7, the mixer and washing screen in the loading stage, together with a flotation cell can be grouped into a loading module. The mixer and washing screen in the stripping stage, together with the filter, can be grouped into a stripping module equipped with a fresh media stage silo and a surfactant storage tank. Practically, the loading module can be arranged in an area about 10 m×10 m, the stripping module can also be arranged in an area about 10 m×10 m. In illustrated in FIG. 8, a plurality of loading modules can share one stripping module.

FIGS. 9*a*-14*b*. The Synthetic Bubbles or Beads

The barren media used in mineral separation as disclosed herein can be synthetic bubbles or beads. The term "loaded media" as disclosed herein refers to synthetic bubbles or beads having mineral particles attached thereto. At least the surface of the synthetic bubbles or beads has a layer of polymer functionalized to attract or attach to the value material or mineral particles in the mixture. The term "polymer bubbles or beads", and the term "synthetic bubbles or beads" are used interchangeably. The term "polymer" in this specification means a large molecule made of many units of the same or similar structure linked together. The unit can be a monomer or an oligomer which forms the basis of, for example, polyamides (nylon), polyesters, polyurethanes, phenol-formaldehyde, urea-formaldehyde, melamine-formaldehyde, polyacetal, polyethylene, polyisobutylene, polyacrylonitrile, poly(vinyl chloride), polystyrene, poly(methyl methacrylates), poly(vinyl acetate), poly(vinylidene chloride), polyisoprene, polybutadiene, polyacrylates, poly(carbonate), phenolic resin, polydimethylsiloxane and other organic or inorganic polymers. The list is not necessarily exhaustive. Thus, the synthetic material can be hard or rigid like plastic or soft and flexible like an elastomer. While the physical properties of the synthetic beads can vary, the surface of the synthetic beads is chemically functionalized to provide a plurality of functional groups to attract or attach to mineral particles. (By way of example, the term "functional group" may be understood to be a group of atoms responsible for the characteristic reactions of a particular compound, including those define the structure of a family of compounds and determine its properties.)

Figure 9B:
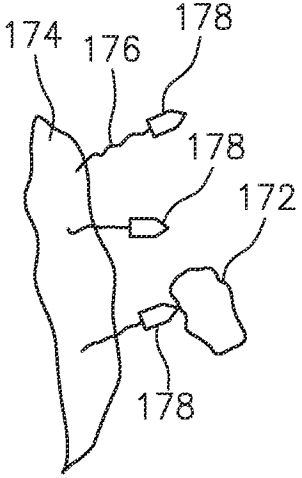
FIG. 9*b* illustrates an enlarged portion of the synthetic bead showing a molecule or molecular segment for attaching a function group to the surface of the synthetic bead, according to some embodiments of the present invention.
Figure 9A:
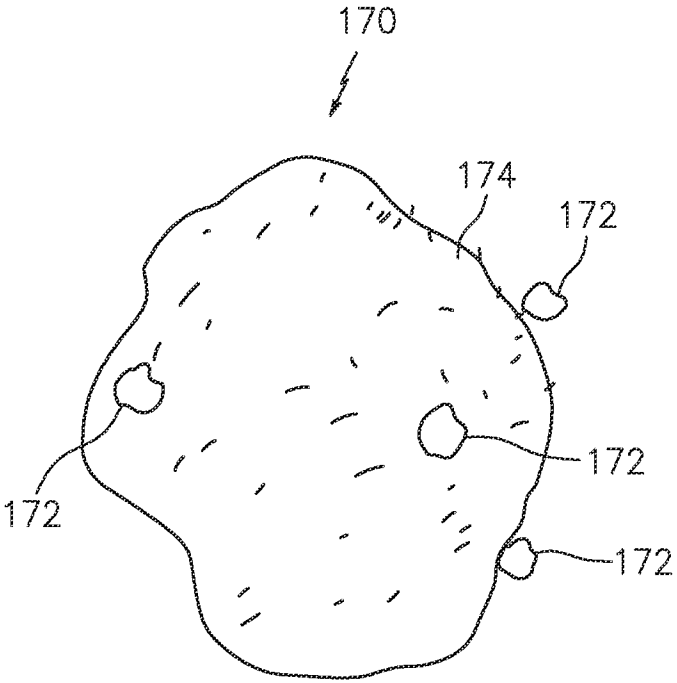
FIG. 9*a* shows a generalized barren media which can be a synthetic bead or bubble, according to some embodiments of the present invention.

For aiding a person of ordinary skill in the art in understanding various embodiments of the present invention, FIG. 9*a* shows a generalized synthetic bead and FIG. 9*b* shows an enlarged portion of the surface. The synthetic bead can be a size-based bead or bubble, weight-based polymer bead and bubble, and/or magnetic-based bead and bubble. As shown in FIGS. 9*a* and 9*b*, the synthetic bead 170 has a bead body to provide a bead surface 174. At least the outside part of the bead body is made of a synthetic material, such as polymer, so as to provide a plurality of molecules or molecular segments 176 on the surface 174. The molecule 176 is used to attach a chemical functional group 178 to the surface 174. In general, the molecule 176 can be a hydrocarbon chain, for example, and the functional group 178 can have an anionic bond for attracting or attaching a mineral, such as copper to the surface 174. A xanthate, for example, has both the functional group 178 and the molecular segment 176 to be incorporated into the polymer that is used to make the synthetic bead 170. A functional group 178 is also known as a collector that is either ionic or non-ionic. The ion can be anionic or cationic. An anion includes oxyhydryl, such as carboxylic, sulfates and sulfonates, and sulfhydral, such as xanthates and dithiophosphates. Other molecules or compounds that can be used to provide the function group 178 include, but are not limited to, thionocarboamates, thioureas, xanthogens, monothiophosphates, hydroquinones and polyamines. Similarly, a chelating agent can be incorporated into or onto the polymer as a collector site for attracting a mineral, such as copper. As shown in FIG. 9*b*, a mineral particle 172 is attached to the functional group 178 on a molecule 176. In general, the mineral particle 172 is much smaller than the synthetic bead 170. Many mineral particles 172 can be attracted to or attached to the surface 174 of a synthetic bead 170.

Figure 10A:
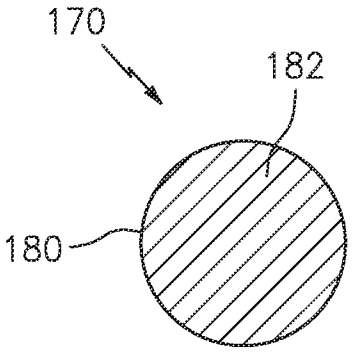
FIG. 10*a* illustrates a synthetic bead having a body made of a synthetic material, according to some embodiments of the present invention.
Figure 10B:
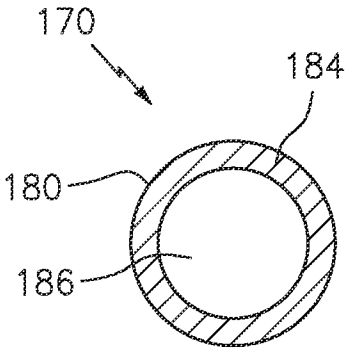
FIG. 10*b* illustrates a synthetic bead with a synthetic shell, according to some embodiments of the present invention.
Figure 10C:
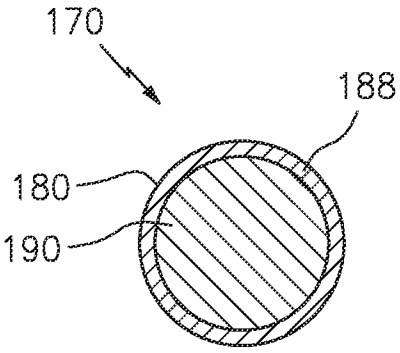
FIG. 10*c* illustrates a synthetic bead with a synthetic coating, according to some embodiments of the present invention.
Figure 10D:
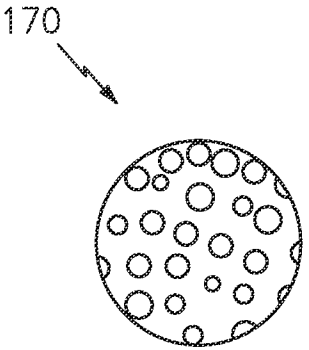
FIG. 10*d* illustrates a synthetic bead taking the form of a porous block, a sponge or foam, according to some embodiments of the present invention.

In some embodiments of the present invention, a synthetic bead has a solid-phase body made of a synthetic material, such as polymer. The polymer can be rigid or elastomeric. An elastomeric polymer can be polyisoprene or polybutadiene, for example. The synthetic bead 170 has a bead body 180 having a surface comprising a plurality of molecules with one or more functional groups for attracting mineral particles to the surface. A polymer having a functional group to collect mineral particles is referred to as a functionalized polymer. In one embodiment, the entire interior part 182 of the synthetic bead 180 is made of the same functionalized material, as shown in FIG. 10*a*. In another embodiment, the bead body 180 comprises a shell 184. The shell 184 can be formed by way of expansion, such as thermal expansion or pressure reduction. The shell 184 can be a micro-bubble or a balloon. In FIG. 10*b*, the shell 184, which is made of functionalized material, has an interior part 186. The interior part 186 can be filled with air or gas to aid buoyancy, for example. The interior part 186 can be used to contain a liquid to be released during the mineral separation process. The encapsulated liquid can be a polar liquid or a non-polar liquid, for example. The encapsulated liquid can contain a depressant composition for the enhanced separation of copper, nickel, zinc, lead in sulfide ores in the flotation stage, for example. The shell 184 can be used to encapsulate a powder which can have a magnetic property so as to cause the synthetic bead to be magnetic, for example. The encapsulated liquid or powder may contain monomers, oligomers or short polymer segments for wetting the surface of mineral particles when released from the beads. For example, each of the monomers or oligomers may contain one functional group for attaching to a mineral particle and an ion for attaching the wetted mineral particle to the synthetic bead. The shell 84 can be used to encapsulate a solid core, such as Styrofoam to aid buoyancy, for example. In yet another embodiment, only the coating of the bead body is made of functionalized polymer. As shown in FIG. 10*c*, the synthetic bead has a core 190 made of ceramic, glass or metal and only the surface of core 190 has a coating 88 made of functionalized polymer. The core 190 can be a hollow core or a filled core depending on the application. The core 190 can be a micro-bubble, a sphere or balloon. For example, a filled core made of metal makes the density of the synthetic bead to be higher than the density of the pulp slurry, for example. The core 190 can be made of a magnetic material so that the para-, ferri-, ferro-magnetism of the synthetic bead is greater than the para-, ferri-, ferro-magnetism of the unwanted ground ore particle in the mixture. In a different embodiment, the synthetic bead can be configured with a ferro-magnetic or ferri-magnetic core that attract to paramagnetic surfaces. A core 90 made of glass or ceramic can be used to make the density of the synthetic bead substantially equal to the density of the pulp slurry so that when the synthetic beads are mixed into the pulp slurry for mineral collection, the beads can be in a suspension state.

According to a different embodiment of the present invention, the synthetic bead 170 can be a porous block or take the form of a sponge or foam with multiple segregated gas filled chambers. The combination of air and the synthetic beads or bubbles 170 can be added to traditional naturally aspirated flotation cell.

It should be understood that the term "bead" does not limit the shape of the synthetic bead of the present invention to be spherical, as shown in FIG. 9. In some embodiments of the present invention, the synthetic bead 170 can have an elliptical shape, a cylindrical shape, a shape of a block. Furthermore, the synthetic bead can have an irregular shape.

Figure 11A:
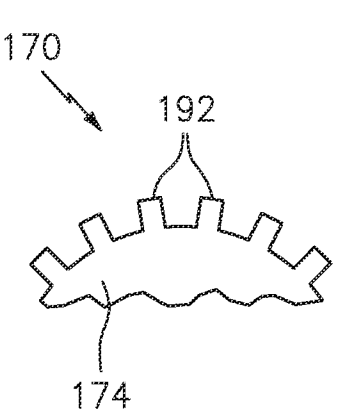
FIG. 11*a* illustrates the surface of a synthetic bead with grooves and/or rods, according to some embodiments of the present invention.
Figure 11B:
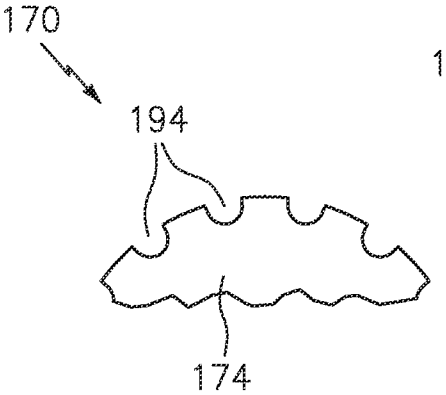
FIG. 11*b* illustrates the surface of a synthetic bead with dents and/or holes, according to some embodiments of the present invention.
Figure 11C:
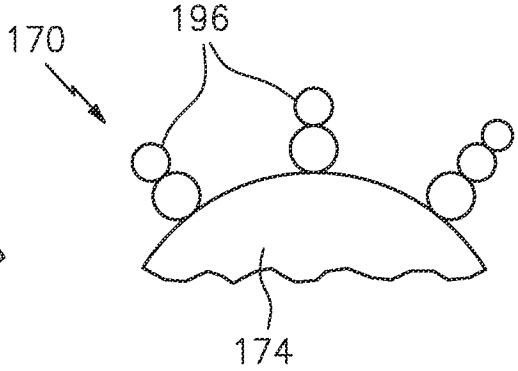
FIG. 11*c* illustrates the surface of a synthetic bead with stacked beads, according to some embodiments of the present invention.
Figure 11D:
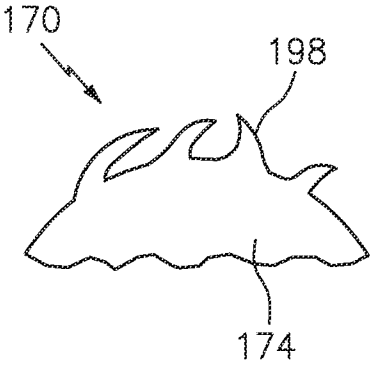
FIG. 11*d* illustrates the surface of a synthetic bead with hair-like physical structures, according to some embodiments of the present invention.

It should also be understood that the surface of a synthetic bead, according to the present invention, is not limited to an overall smooth surface as shown in FIG. 9*a*. In some embodiments of the present invention, the surface can be irregular and rough. For example, the surface 174 can have some physical structures 192 like grooves or rods as shown in FIG. 11*a*. The surface 174 can have some physical structures 194 like holes or dents as shown in FIG. 11*b*. The surface 174 can have some physical structures 196 formed from stacked beads as shown in FIG. 11*c*. The surface 174 can have some hair-like physical structures 198 as shown in FIG. 11*d*. In addition to the functional groups on the synthetic beads that attract mineral particles to the bead surface, the physical structures can help trapping the mineral particles on the bead surface. The surface 174 can be configured to be a honeycomb surface or sponge-like surface for trapping the mineral particles and/or increasing the contacting surface.

It should also be noted that the synthetic beads of the present invention can be realized by a different way to achieve the same goal. Namely, it is possible to use a different means to attract the mineral particles to the surface of the synthetic beads. For example, the surface of the polymer beads, shells can be functionalized with a hydrophobic chemical molecule or compound. Alternatively, the surface of beads made of glass, ceramic and metal can be coated with hydrophobic chemical molecules or compounds. Using the coating of glass beads as an example, polysiloxanates can be used to functionalize the glass beads in order to make the synthetic beads. In the pulp slurry, xanthate and hydroxamate collectors can also be added therein for collecting the mineral particles and making the mineral particles hydrophobic. When the synthetic beads are used to collect the mineral particles in the pulp slurry having a pH value around 8-9, it is possible to release the mineral particles on the enriched synthetic beads from the surface of the synthetic beads in an acidic solution, such as a sulfuric acid solution. It is also possible to release the mineral particles carrying with the enriched synthetic beads by sonic agitation, such as ultrasonic waves.

The multiplicity of hollow objects, bodies, elements or structures may include hollow cylinders or spheres, as well as capillary tubes, or some combination thereof. The scope of the invention is not intended to be limited to the type, kind or geometric shape of the hollow object, body, element or structure or the uniformity of the mixture of the same. Each hollow object, body, element or structure may be configured with a dimension so as not to absorb liquid, including water, including where the dimension is in a range of about 20-30 microns. Each hollow object, body, element or structure may be made of glass or a glass-like material, as well as some other suitable material either now known or later developed in the future.

By way of example, the multiplicity of hollow objects, bodies, elements or structures that are received in the mixture may include a number in a range of multiple thousands of bubbles or beads per cubic foot of mixture, although the scope of the invention is not intended to be limited per se to the specific number of bubbles. For instance, a mixture of about three thousand cubic feet may include multiple millions of bubbles or beads, e.g., having a size of about 1 millimeter, in three thousand cubic feet of the mixture.

The multiplicity of hollow objects, bodies, elements or structures may be configured with chemicals applied to prevent migration of liquid into respective cavities, unfilled spaces or holes before the wet concrete mixture cures, including where the chemicals are hydrophobic chemicals.

The one or more bubbles may take the form of a small quantity of gas, including air, that is trapped or maintained in the cavities, unfilled spaces, or holes of the multiplicity of hollow objects, bodies, elements or structures.

The scope of the invention is intended to include the synthetic bubbles or beads shown herein being made from a polymer or polymer-based material, or a silica or silica-based, or a glass or glass-based material.

Figure 12B:
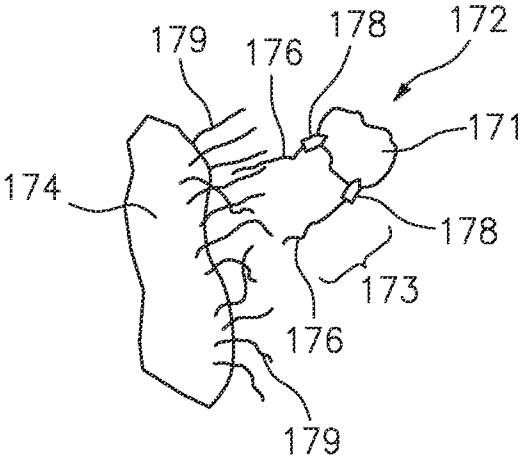
FIG. 12*b* illustrates an enlarged portion of the hydrophobic synthetic bead showing a wetted mineral particle attaching the hydrophobic surface of the synthetic bead.
Figure 12C:
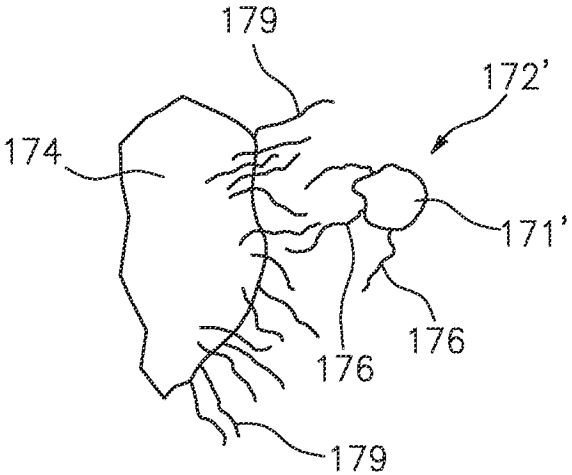
FIG. 12*c* illustrates an enlarged portion of the hydrophobic synthetic bead showing a hydrophobic non-mineral particle attaching the hydrophobic surface of the synthetic bead.
Figure 12A:
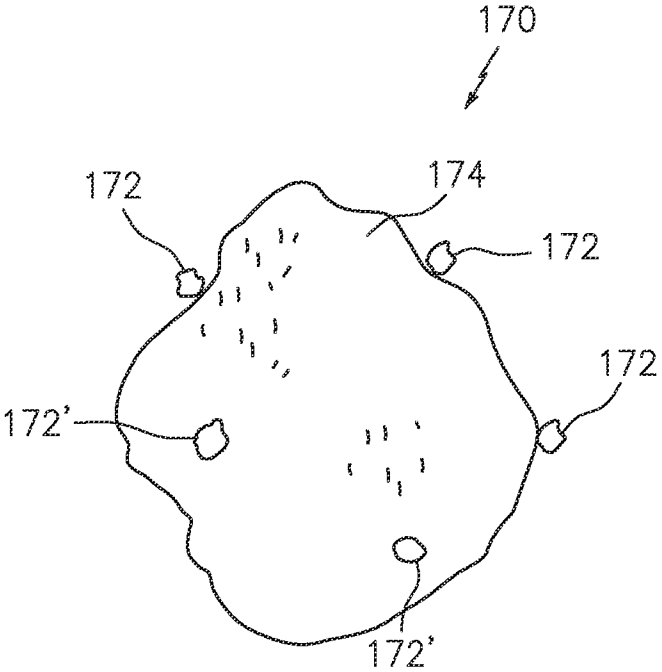
FIG. 12*a* shows a generalized synthetic bead functionalized to be hydrophobic, according to some embodiments of the present invention.

It should be understood that the sized-based bead or bubble, weight-based bead or bubble, magnetic-based bead or bubble as described in conjunction with FIGS. 9*a*-11*d* can be functionalized to be hydrophobic so as to attract mineral particles. FIG. 12*a* shows a generalized hydrophobic synthetic bead, FIG. 12*b* shows an enlarged portion of the bead surface and a mineral particle, and FIG. 12*b* shows an enlarged portion of the bead surface and a non-mineral particle. As shown in FIG. 12*a* the hydrophobic synthetic bead 170 has a polymer surface 174 and a plurality of particles 172, 172' attached to the polymer surface 174. FIG. 12*b* shows an enlarged portion of the polymer surface 174 on which a plurality of molecules 179 rendering the polymer surface 174 hydrophobic.

A mineral particle 171 in the slurry, after combined with one or more collector molecules 173, becomes a wetted mineral particle 172. The collector molecule 173 has a functional group 178 attached to the mineral particle 171 and a hydrophobic end or molecular segment 176. The hydrophobic end or molecular segment 176 is attracted to the hydrophobic molecules 179 on the polymer surface 174. FIG. 12*c* shows an enlarged portion of the polymer surface 174 with a plurality of hydrophobic molecules 179 for attracting a non-mineral particle 172'. The non-mineral particle 172' has a particle body 171' with one or more hydrophobic molecular segments 76 attached thereto. The hydrophobic end or molecular segment 176 is attracted to the hydrophobic molecules 179 on the polymer surface 174. The term "polymer" in this specification means a large molecule made of many units of the same or similar structure linked together. Furthermore, the polymer associated with FIGS. 12*a*-12*c* can be naturally hydrophobic or functionalized to be hydrophobic. Some polymers having a long hydrocarbon chain or silicon-oxygen backbone, for example, tend to be hydrophobic. Hydrophobic polymers include polystyrene, poly(d,l-lactide), poly(dimethylsiloxane), polypropylene, polyacrylic, polyethylene, etc. The bubbles or beads, such as synthetic bead 170 can be made of glass to be coated with hydrophobic silicone polymer including polysiloxanates so that the bubbles or beads become hydrophobic. The bubbles or beads can be made of metal to be coated with silicone alkyd copolymer, for example, so as to render the bubbles or beads hydrophobic. The bubbles or beads can be made of ceramic to be coated with fluoroalkylsilane, for example, so as to render the bubbles and beads hydrophobic. The bubbles or beads can be made of hydrophobic polymers, such as polystyrene and polypropylene to provide a hydrophobic surface. The wetted mineral particles attached to the hydrophobic synthetic bubble or beads can be released thermally, ultrasonically, electromagnetically, mechanically or in a low pH environment.

Figure 13B:
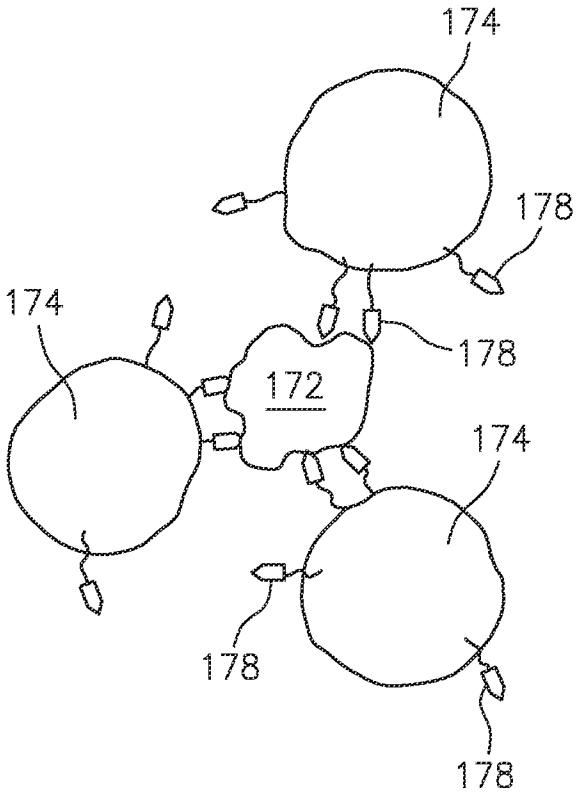
FIG. 13*b* illustrates a mineral particle being attached to a number of slightly larger synthetic beads at the same time.
Figure 13A:
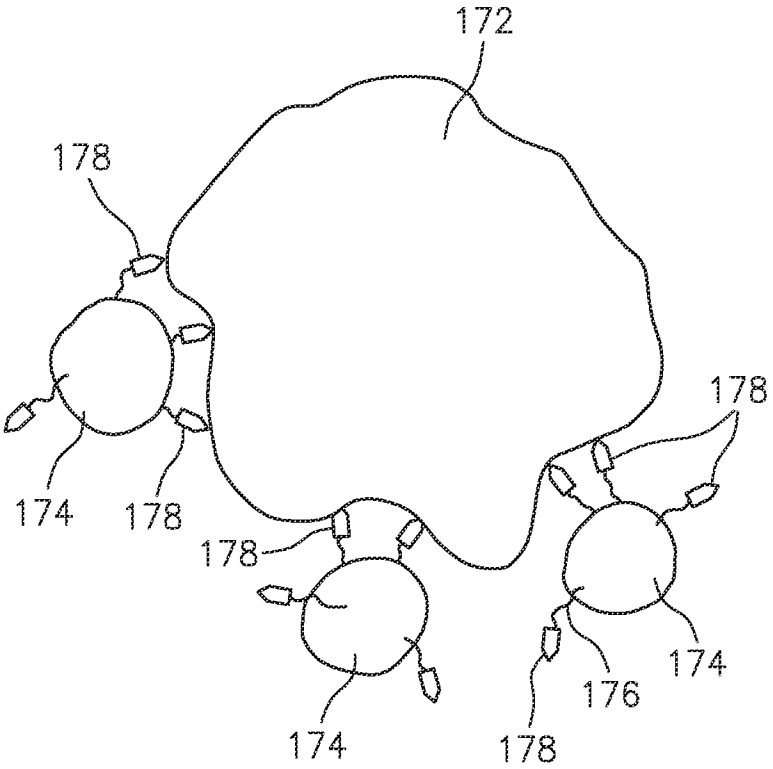
FIG. 13*a* illustrates a mineral particle being attached to a number of much smaller synthetic beads at the same time.
Figure 14B:
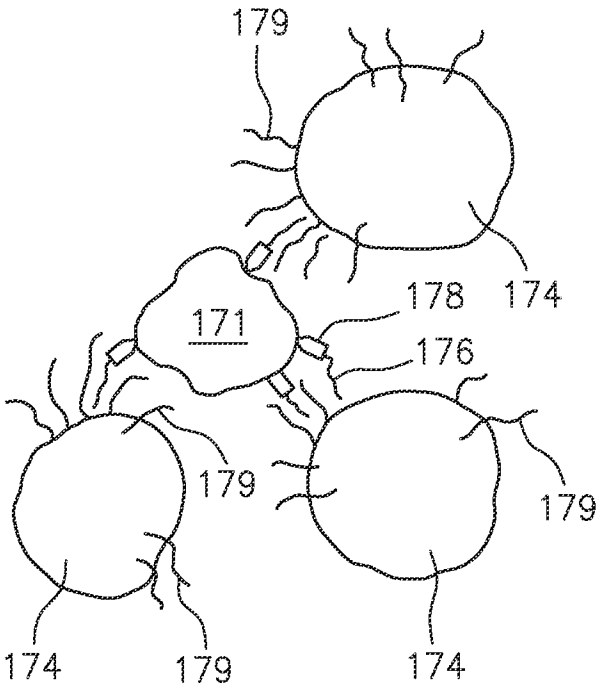
FIG. 14*b* illustrates a wetted mineral particle being attached to a number of slightly larger hydrophobic synthetic beads at the same time.
Figure 14A:
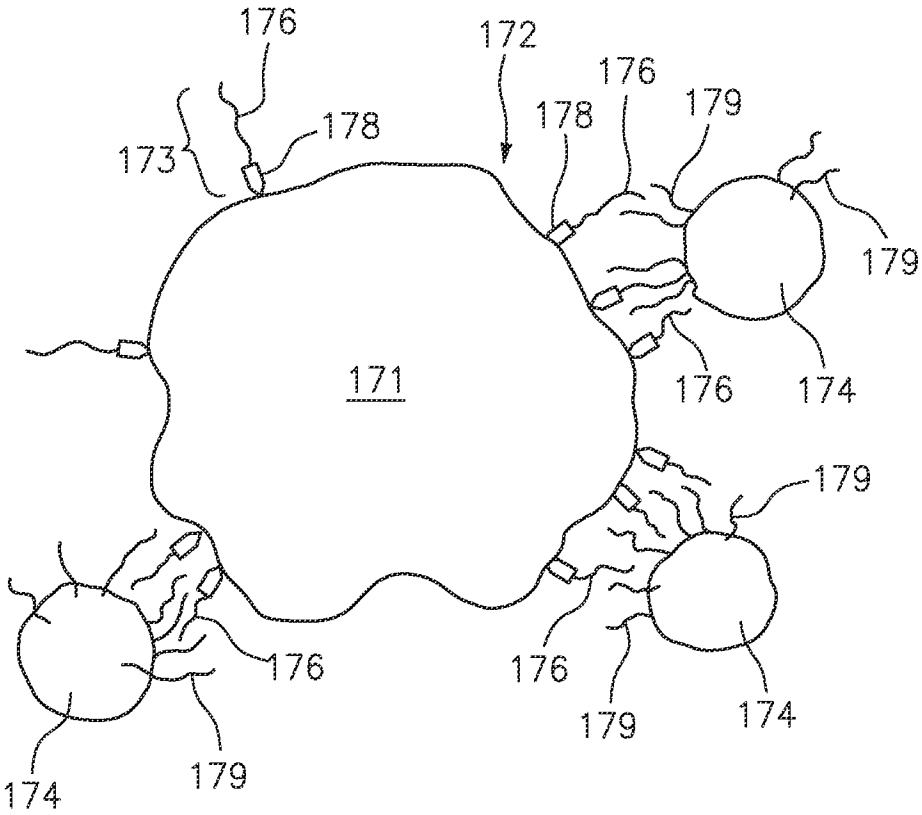
FIG. 14*a* illustrates a wetted mineral particle being attached to a number of much smaller hydrophobic synthetic beads at the same time.

FIG. 13*a* illustrates a scenario where a mineral particle 172 is attached to a number of synthetic beads 174 at the same time. Thus, although the synthetic beads 174 are much smaller in size than the mineral particle 172, a number of synthetic beads 174 may be able to lift the mineral particle 172 upward in a flotation cell. Likewise, a smaller mineral particle 172 can also be lifted upward by a number of synthetic beads 174 as shown in FIG. 13*b*. In order to increase the likelihood for this "cooperative" lifting to occur, a large number of synthetic beads 174 can be mixed into the slurry. Unlike air bubbles, the density of the synthetic beads can be chosen such that the synthetic beads may stay along in the slurry before they rise to surface in a flotation cell.

The selective recirculation circuit 80 of the present invention has been shown as a block diagram in FIG. 2, a group of separate components in FIG. 3 and a graphical representation in FIGS. 7 and 8. The selective recirculation circuit 80 and its components can be used in coarse particle mineral concentration in various configurations in FIGS. 4, 5 and 6. It should be understood that the drawings are also illustration purposes only. Each of the components in the circuit can be configured differently. The barren media (synthetic beads) and the loaded media (synthetic beads with mineral particles attached thereon) as depicted in FIGS. 9*a*-14*b* are for illustration purposed only because it is almost impossible to present the real molecules on a drawing.

The Related Family

This application is related to a family of applications, including at least the following:

This application is related to a family of nine PCT applications, which were all concurrently filed on 25 May 2012, as follows:

PCT application no. PCT/US12/39528, entitled "Flotation separation using lightweight synthetic bubbles and beads;"

PCT application no. PCT/US12/39524, entitled "Mineral separation using functionalized polymer membranes;"

PCT application no. PCT/US12/39540, entitled "Mineral separation using sized, weighted and magnetized beads;"

PCT application no. PCT/US12/39576, entitled "Synthetic bubbles/beads functionalized with molecules for attracting or attaching to mineral particles of interest;"

PCT application no. PCT/US12/39591, entitled "Method and system for releasing mineral from synthetic bubbles and beads;" PCT application no. PCT/US12/39596, entitled "Synthetic bubbles and beads having hydrophobic surface;"

PCT application no. PCT/US12/39631 (712-2.385//CCS-0092), entitled 37 Mineral separation using functionalized filters and membranes;

PCT application no. PCT/US12/39655, entitled "Mineral recovery in tailings using functionalized polymers;" and PCT application no. PCT/US12/39658, entitled "Techniques for transporting synthetic beads or bubbles In a flotation cell or column,"

all of which are incorporated by reference in their entirety.

This application also related to PCT application no. PCT/US13/28303, filed 28 Feb. 2013, entitled "Method and system for flotation separation in a magnetically controllable and steerable foam," which is also hereby incorporated by reference in its entirety.

This application also related to PCT application no. PCT/US13/42202, filed 22 May 2013, entitled "Charged engineered polymer beads/bubbles functionalized with molecules for attracting and attaching to mineral particles of interest for flotation separation," which is also hereby incorporated by reference in its entirety.

This application also related to PCT application no. PCT/US14/37823, filed 13 May 2014, entitled "Polymer surfaces having siloxane functional group," which claims benefit to U.S. patent application Ser. No. 14/890,477, filed 11 Nov. 2014, which is also hereby incorporated by reference in its entirety.

This application also related to PCT application no. PCT/US13/73855, filed 9 Dec. 2013, entitled "Techniques for agglomerating mature fine tailing by injecting a polymer in a process flow," which is also hereby incorporated by reference in its entirety.

This application also related to PCT application no. PCT/US15/33485, filed 1 Jun. 2015, entitled "Mineral recovery using hydrophobic polymer surfaces," which is also hereby incorporated by reference in its entirety.

This application also related to PCT application no. PCT/US15/66390, filed 17 Dec. 2015, entitled "Transportable modular system for enhanced mineral recovery from tailings lines and deposits," which is also hereby incorporated by reference in its entirety.

THE SCOPE OF THE INVENTION

It should be further appreciated that any of the features, characteristics, alternatives or modifications described regarding a particular embodiment herein may also be applied, used, or incorporated with any other embodiment described herein. In addition, it is contemplated that, while the embodiments described herein are useful for homogeneous flows, the embodiments described herein can also be used for dispersive flows having dispersive properties (e.g., stratified flow).

Although the invention has been described and illustrated with respect to exemplary embodiments thereof, the foregoing and various other additions and omissions may be made therein and thereto without departing from the spirit and scope of the present invention.

What is claimed is:

1. An apparatus comprising:

a loading stage configured to receive barren media and a slurry containing mineral particles and to load the barren media with the mineral particles for providing loaded media;

a stripping stage configured to strip the loaded media with a stripping solution into a first portion comprising the barren media and a second portion containing the mineral particles and the stripping solution; and a filtering stage configured to separate the mineral particles from the stripping solution in the second portion, wherein the mineral particles comprise recovered particles having exposed hydrophobic surfaces and unrecovered particles, and wherein the loading stage comprises a mixing stage and a screening stage, the mixing stage configured to load the barren media with the recovered particles and the screening stage configured to discharge the unrecovered particles from the loading stage.

2. The apparatus according to claim 1, wherein the barren media comprises engineered material having molecules with a functional group configured to attract the mineral particles to the engineered material.

3. The apparatus according to claim 2, wherein the engineered material comprises synthetic bubbles and beads having a surface to provide the molecules.

4. The apparatus according to claim 3, wherein the synthetic bubbles and beads are made of a hydrophobic material having the molecules.

5. The apparatus according to claim 3, wherein the surface of the synthetic bubbles and beads comprises a coating having a hydrophobic chemical selected from the group consisting of poly(dimethysiloxane), hydrophobically-modified ethyl hydroxyethyl cellulose polysiloxanes, alkylsilane and fluoroalkylsilane.

6. The apparatus according to claim 3, wherein the surface of the synthetic bubbles and beads comprises a coating made of one or more dimethyl siloxane, dimethyl-terminated polydimethylsiloxane and dimethyl methylhydrogen siloxane.

7. The apparatus according to claim 3, wherein the surface of the synthetic bubbles and beads comprises a coating made of a siloxane derivative.

8. The apparatus according to claim 1, wherein the stripping stage is arranged to form a first loop with the loading stage, and to form a second loop with the filtering stage.

9. The apparatus according to claim 8, wherein the stripping stage configured to provide the first portion containing the barren media to the loading stage and to receive the loaded media via the first loop; and to provide the second portion to the filtering stage and to receive the stripping solution from the filtering stage via the second loop.

10. The apparatus according to claim 8, wherein the filtering stage is configured to output concentrates containing the mineral particles.

11. The apparatus according to claim 1, wherein the loading stage comprises a media loading stage and a loaded media recovery stage, the media loading stage configured to load the barren media with mineral particles, the loaded media recovery stage configured to separate the loaded media from the slurry.

12. The apparatus according to claim 11, wherein the stripping stage comprises a media stripping stage and a barren media recovery stage, the media stripping stage configured to strip the mineral particles from the loaded media, the barren media recovery stage configured to return the barren particles in the stripping stage to the media loading stage.

13. The apparatus according to claim 12, wherein the mineral particles comprise recovered particles and unrecovered particles, the loaded media containing the recovered particles, and wherein the media loading stage comprises an input arranged to receive the slurry and the loaded media recovery stage comprises a first output arranged to discharge the unrecovered particles, and wherein the filtering stage comprises a second output arranged to output the recovered particles.

14. The apparatus according to claim 13, wherein the input is arranged to receive the slurry from a flotation cell.

15. An apparatus comprising:

a loading stage configured to receive barren media and a slurry containing mineral particles and to load the barren media with the mineral particles for providing loaded media;

a stripping stage configured to strip the loaded media with a stripping solution into a first portion comprising the barren media and a second portion containing the mineral particles and the stripping solution; and a filtering stage configured to separate the mineral particles from the stripping solution in the second portion, wherein the loading stage comprises a media loading stage and a loaded media recovery stage, the media loading stage configured to load the barren media with mineral particles, the loaded media recovery stage configured to separate the loaded media from the slurry. and wherein the stripping stage comprises a media stripping stage and a barren media recovery stage, the media stripping stage configured to strip the mineral particles from the loaded media, the barren media recovery stage configured to return the barren particles in the stripping stage to the media loading stage, and wherein the mineral particles comprise recovered particles and unrecovered particles, the loaded media containing the recovered particles, and wherein the media loading stage comprises an input arranged to receive the slurry and the loaded media recovery stage comprises a first output arranged to discharge the unrecovered particles, and wherein the filtering stage comprises a second output arranged to output the recovered particles, said apparatus further comprising a milling stage and a classifying stage, the milling stage configured to mill a first comminution product into a second comminution product, the classifying stage configured to separate coarser particles from finer particles in the second comminution product, and wherein the slurry comprises process water and the coarser particles containing the mineral particles, and wherein the input is arranged to receive the slurry from the classifying stage, and the second output is arranged to return the recovered particles to the milling stage.

16. The apparatus according to claim 15, wherein the finer particles in the second comminution product are directed to a further milling stage.

17. The apparatus according to claim 16, wherein the finer particles in the second comminution product are further regrinding in the further milling stage into a first reground product and a second reground product having coarse particles than the first reground product, wherein the first reground product is directed to flotation.

18. The apparatus according to claim 17, wherein the second reground product also comprises unrecovered particles to be discharged as tails.

19. A method for processing a slurry having mineral particles, comprising:

causing barren media to contact with the slurry;

loading the mineral particles on the barren media for providing loaded media in the slurry;

separating the loaded media from the slurry;

stripping the loaded media to obtain mineral particles and barren media; and discharging the mineral particles in a concentrate stream, wherein the mineral particles comprise recovered particles having exposed hydrophobic surfaces and unrecovered particles, and wherein the loaded media comprises recovered particles, said method further comprising discharging the unrecovered particles after said loading.

20. The method according to claim 19, wherein said causing and loading are carried out in a loading stage and said separating and stripping are carried out in a stripping stage, said method further comprising:

returning the barren media obtaining from said stripping to the loading stage.

21. The method according to claim 20, wherein a stripping solution is used in the stripping stage in said stripping, said method further comprising:

receiving mixture of the mineral particles and the stripping solution from the stripping stage;

separating the mineral particles and the stripping solution from the mixture; and providing the stripping solution to the stripping stage.

22. The method according to claim 20, wherein the engineered material comprises synthetic bubbles and beads having a surface to provide the molecules.

23. The method according to claim 22, wherein the synthetic bubbles and beads are made of a hydrophobic material having the molecules.

24. The method according to claim 22, wherein the surface of the synthetic bubbles and beads comprises a coating having a hydrophobic chemical selected from the group consisting of poly(dimethysiloxane), hydrophobically-modified ethyl hydroxyethyl cellulose polysiloxanes, alkylsilane and fluoroalkylsilane.

25. The apparatus according to claim 22, wherein the surface of the synthetic bubbles and beads comprises a coating made of one or more dimethyl siloxane, dimethyl-terminated polydimethylsiloxane and dimethyl methylhydrogen siloxane.

26. The apparatus according to claim 22, wherein the surface of the synthetic bubbles and beads comprises a coating made of a siloxane derivative.

27. The method according to claim 19, wherein the barren media comprises engineered material having molecules with a functional group configured to attract the mineral particles to the engineered material.

* * * * *